US010406818B2

(12) United States Patent
Hirata et al.

(10) Patent No.: US 10,406,818 B2
(45) Date of Patent: Sep. 10, 2019

(54) TANK AND LIQUID CONSUMING APPARATUS

(71) Applicant: BROTHER KOGYO KABUSHIKI KAISHA, Nagoya-shi, Aichi-ken (JP)

(72) Inventors: Kenichi Hirata, Nagoya (JP); Taichi Shirono, Nagoya (JP); Yoshinori Osakabe, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/939,548

(22) Filed: Mar. 29, 2018

(65) Prior Publication Data

US 2018/0281442 A1 Oct. 4, 2018

(30) Foreign Application Priority Data

Mar. 31, 2017 (JP) ..... 2017-071364

(51) Int. Cl.
*B41J 2/175* (2006.01)
*B41J 29/02* (2006.01)
*B41J 29/13* (2006.01)

(52) U.S. Cl.
CPC ..... *B41J 2/17566* (2013.01); *B41J 2/1752* (2013.01); *B41J 2/17509* (2013.01); *B41J 2/17513* (2013.01); *B41J 2/17523* (2013.01); *B41J 2/17553* (2013.01); *B41J 29/02* (2013.01); *B41J 29/13* (2013.01); *B41J 2002/17573* (2013.01)

(58) Field of Classification Search
CPC ..... B41J 2/17566; B41J 2/17509; B41J 2/17513; B41J 2/1752; B41J 2/17523; B41J 2/17553; B41J 2/02; B41J 2/13; B41J 2002/17573
USPC ..... 347/85
See application file for complete search history.

(56) References Cited

U.S. PATENT DOCUMENTS

2002/0196316 A1* 12/2002 Nakamura ..... B41J 2/175 347/84
2012/0056938 A1 3/2012 Ishizawa et al.
2016/0052286 A1* 2/2016 Kimura ..... B41J 2/17509 347/86

FOREIGN PATENT DOCUMENTS

JP 2012-51306 A 3/2012
JP 2016-22726 A 2/2016
JP 2016-87846 A 5/2016

* cited by examiner

*Primary Examiner* — Huan H Tran
*Assistant Examiner* — Alexander D Shenderov
(74) *Attorney, Agent, or Firm* — Merchant & Gould P.C.

(57) ABSTRACT

A tank installed in a liquid consuming apparatus includes: a first wall forming a first end of a storage chamber storing a liquid and allowing a user to visually confirm the liquid stored in the storage chamber; a second wall forming a second end of the storage chamber facing the first end of the storage chamber in a first direction; a third wall connected to an upper end of the first wall and having an inlet through which the liquid is supplied to the storage chamber; and an inner wall extending from at least one of inner surfaces of the first and third walls and extending in a direction having a component of an up-down direction. Each of the inner surfaces of the first and third walls includes an offset area different from the inlet in a second direction orthogonal to the first direction and the up-down direction.

25 Claims, 14 Drawing Sheets

TANK AND LIQUID CONSUMING APPARATUS

CROSS REFERENCE TO RELATED APPLICATION

The present application claims priority from Japanese Patent Application No. 2017-071364 filed on Mar. 31, 2017, the disclosure of which is incorporated herein by reference in its entirety.

BACKGROUND

Field of the Invention

The present invention relates to a tank that can be replenished with liquid via an inlet and a liquid consuming apparatus provided with the tank.

Description of the Related Art

There is known a printer that includes: a tank that can be replenished with ink; and a recording head that records an image on a sheet by jetting, from nozzles, the ink supplied from the tank. When the ink in the tank is consumed, a user can replenish with ink stored in a bottle, from an inlet provided in the tank.

The tank of the above printer typically includes a visual-confirmation wall. The visual-confirmation wall allows a user to confirm a residual amount of ink stored in the tank from the outside. The visual-confirmation wall is exposed to the outside of the printer in a state where the tank is placed in the printer. The visual-confirmation wall is formed from a material having translucency to enable the interior of the tank to be visually confirmed from the exterior of the tank.

SUMMARY

The inlet of the tank is typically provided at a position accessible from the outside, that is, at a position exposed to the outside of the printer. Namely, the inlet of the tank is positioned close to the visual-confirmation wall. In that configuration, when the tank is replenished with the ink via the inlet, the ink supplied is liable to adhere to an inner surface of the visual-confirmation wall at a position higher than an actual liquid surface of the ink. This makes it difficult for a user to accurately confirm an amount of ink stored in the tank. This problem is conspicuous or prominent when the tank is replenished with ink having low water repellency.

The present teaching has been made in view of the above circumstances, and an object of the present teaching is to provide a tank that can be replenished with liquid and that allows a user to accurately confirm an amount of liquid stored in the tank from the outside.

According to a first aspect of the present teaching, there is provided a tank installed in a liquid consuming apparatus. The tank includes: a first wall forming a first end, in a first direction along a horizontal direction, of a storage chamber configured to storing liquid to be consumed in the liquid consuming apparatus and allowing the liquid stored in the storage chamber to be visually confirmed from outside the tank; a second wall forming a second end of the storage chamber which faces the first end of the storage chamber in the first direction; a third wall connected to an upper end of the first wall and having an inlet through which the liquid is supplied to the storage chamber; and an inner wall extending from at least one of an inner surface of the first wall and an inner wall of the third wall and extending along at least one of the inner surface of the first wall and the inner surface of the third wall in a direction having a component of an up-down direction. Each of the inner surface of the first wall and the inner surface of the third wall includes an offset area which is in a position different from that of the inlet in a second direction orthogonal to the first direction and the up-down direction. At least a part of the inner wall is positioned below the inlet and positioned between the inlet and the offset area in the second direction.

In the above configuration, the inner wall is positioned between the inlet and the offset area in the second direction. Thus, when the liquid supplied from the inlet flows in the second direction or is scattered, it is possible to reduce the adhesion of liquid to the offset area of the inner surface of the first wall. A user thus can accurately confirm an amount of liquid stored in the storage chamber from the outside.

According to a second aspect of the present teaching, there is provided a liquid consuming apparatus, including: the tank as defined in the first aspect; and a cover configured to cover, from outside the tank, the first wall of the tank. The cover includes an opening by which a part of the first wall on an opposite side of the inlet to the inner wall in the second direction is exposed.

In the above configuration, a part of the first wall, to which the liquid supplied is not likely to adhere, is exposed from the opening. This allows a user to easily confirm an amount of liquid stored in the storage chamber. A part of the first wall, to which the liquid supplied is likely to adhere, is covered with the cover, making it possible to hide a part of the first wall, to which the liquid scattered in its supply adheres, from the outside.

According to a third aspect of the present teaching, there is provided a tank installed in a liquid consuming apparatus. The tank includes: a first wall forming a first end, in a first direction along a horizontal direction, of a storage chamber configured to store liquid to be consumed in the liquid consuming apparatus and allowing the liquid stored in the storage chamber to be visually confirmed from outside the tank; a second wall forming a second end of the storage chamber which faces the first end of the storage chamber in the first direction; a third wall connected to an upper end of the first wall and having an inlet through which the liquid is supplied to the storage chamber; and an inner wall extending from at least one of an inner surface of the first wall and an inner wall of the third wall and extending along at least one of the inner surface of the first wall and the inner surface of the third wall in a direction inclined to a second direction which is orthogonal to the first direction and an up-down direction. Each of the inner surface of the first wall and the inner surface of the third wall includes a non-offset area which is in the same position as the inlet in the second direction. At least a part of the inner wall is positioned below the inlet and extends from one end to the other end of the non-offset area in the second direction.

In the above configuration, the inner wall is positioned below the inlet. Thus, when the liquid supplied from the inlet flows downward or is scattered, it is possible to reduce the adhesion of liquid to the non-offset area of the inner surface of the first wall. A user thus can accurately confirm an amount of liquid stored in the storage chamber from the outside.

According to a fourth aspect of the present teaching, there is provided a liquid consuming apparatus, including: the tank as defined in the third aspect; and a cover configured to cover, from outside the tank, the first wall of the tank. The cover includes an opening by which a part of the first wall positioned immediately below the inner wall is exposed.

In the above configuration, a part of the first wall, to which the liquid supplied is not likely to adhere, is exposed from the opening. This allows a user to easily confirm an amount of liquid stored in the storage chamber. A part of the first wall, to which the liquid supplied is likely to adhere, is covered with the cover, making it possible to hide a part of the first wall, to which the liquid scattered in its supply adheres, from the outside.

BRIEF DESCRIPTION OF THE DRAWINGS

FIGS. 1A and 1B are perspective views each depicting an external appearance of a multifunctional peripheral, wherein FIG. 1A depicts a state in which a cover is closed and FIG. 1B depicts a state in which the cover is open.

DESCRIPTION OF THE EMBODIMENTS

Figure 1A:
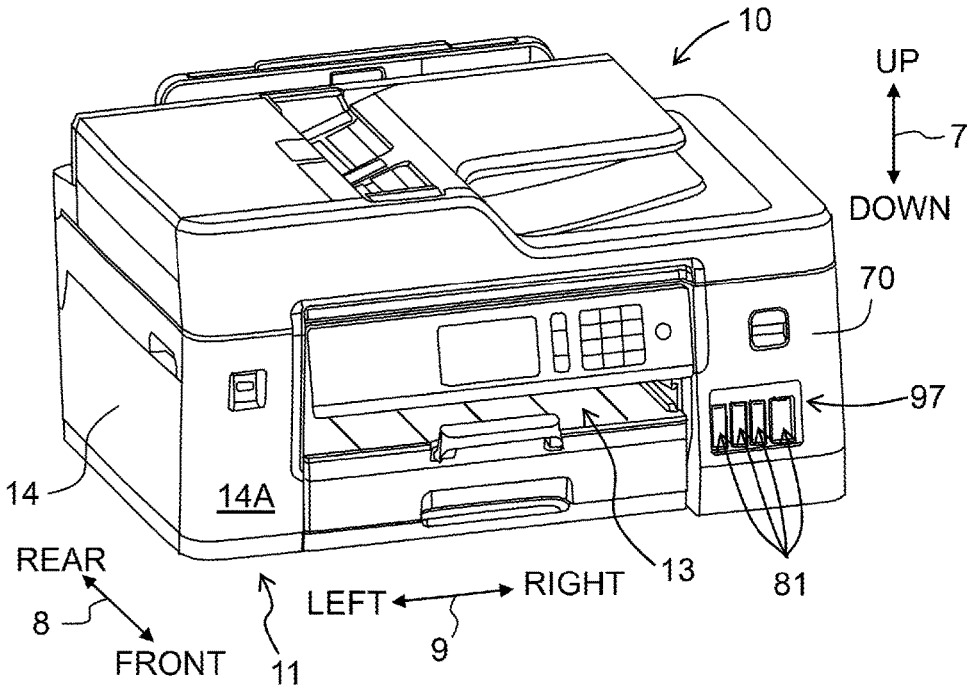

Embodiments of the present teaching are described below. Note that the embodiments described below are merely examples of the present teaching, and it goes without saying that the embodiments of the present teaching may be appropriately changed in a range that does not alter the gist or essential characteristics of the present teaching. In the following description, a posture (the posture of FIGS. 1A and 1B) where a multifunction peripheral 10 and an ink tank 100 installed in the multifunction peripheral 10 are usably disposed in a horizontal plane is described as a "usable posture". An up-down direction 7 is defined with reference to the usable posture. A front-rear direction 8 (an example of a first direction) is defined assuming a surface provided with an opening 13 of the multifunction peripheral 10 to be a front surface. A left-right direction 9 (an example of a second direction) is defined viewing the multifunction peripheral 10 from the front surface. In this embodiment, in the usable posture, the up-down direction 7 corresponds to a vertical direction, and the front-rear direction 8 and the left-right direction 9 correspond to horizontal directions. The front-rear direction 8 is orthogonal to the left-right direction 9. Note that an upward orientation is a component of the up-down direction 7, and a downward orientation is also a component of the up-down direction 7. Similarly, a leftward orientation and a rightward orientation are each components of the left-right direction 9. A frontward orientation and a rearward orientation are each components of the front-rear direction 8.

[First Embodiment]

Figure 1B:
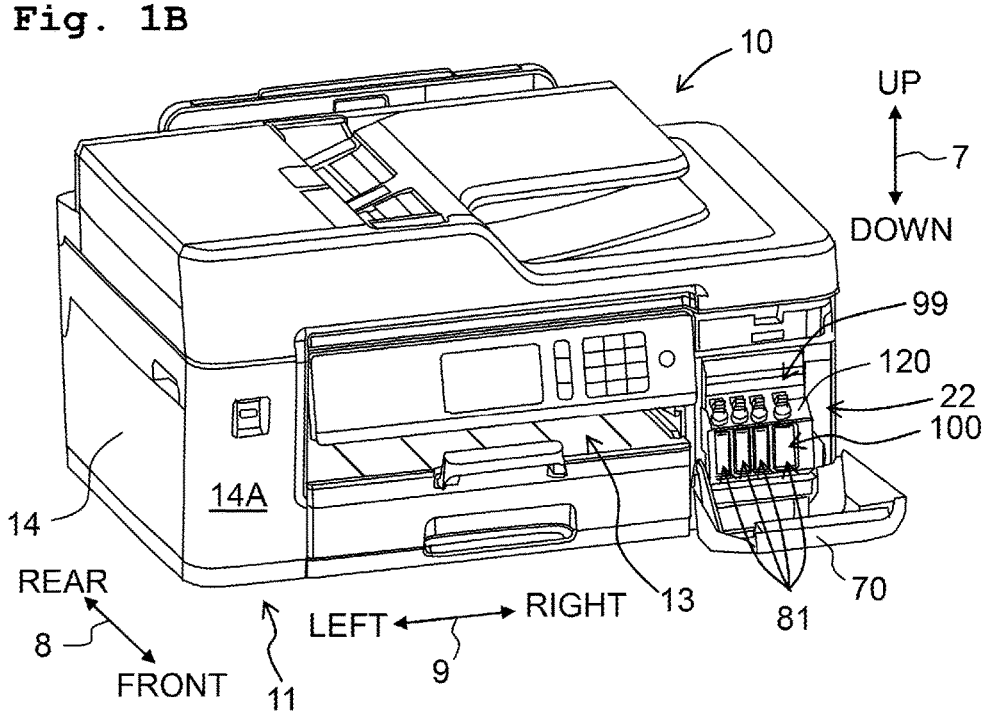
Figure 2:
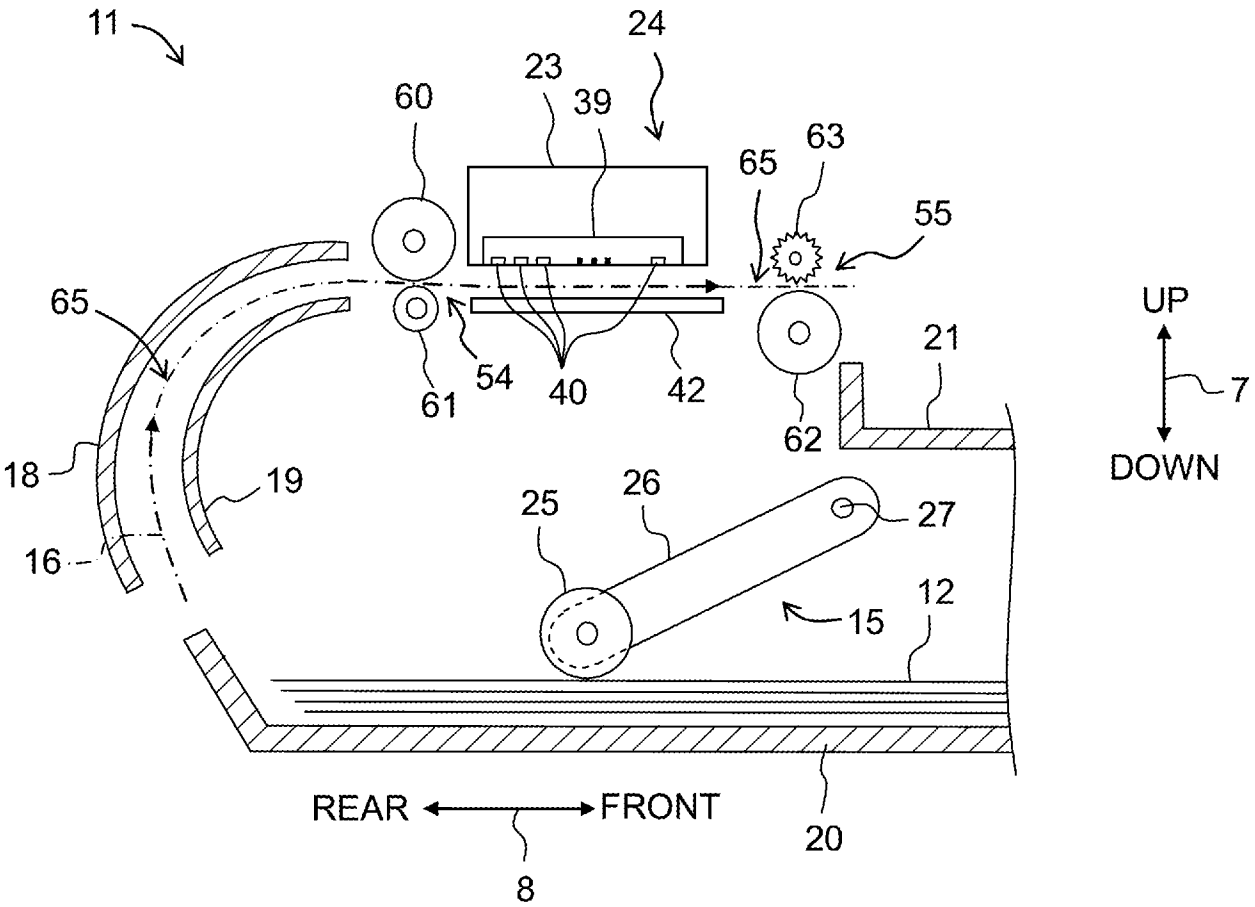
FIG. 2 is a longitudinal cross-sectional view schematically depicting an internal structure of a printer unit.

In the following, a first embodiment of the present teaching is explained. As depicted in FIGS. 1A and 1B, the multifunction peripheral 10 (an example of a liquid consuming apparatus) has roughly a rectangular parallelepiped shape. A printer unit 11 that records an image on a sheet 12 (refer to FIG. 2) by an ink-jet recording system, is provided in a lower portion of the multifunction peripheral 10. The printer unit 11 has a casing 14. The opening 13 is formed in a front wall 14A of the casing 14. As depicted in FIG. 2, the following are disposed on the inside of the casing 14, namely, a feed unit 15, a feed tray 20, a discharge tray 21, a conveyance roller unit 54, a recording unit 24, a discharge roller unit 55, a platen 42, and a tank set 99 (see FIG. 1B). The multifunction peripheral 10 has various functions such as a facsimile function and a print function. The state depicted in FIGS. 1A and 1B is the usable posture of the multifunction peripheral 10.

<Feed Tray 20, Discharge Tray 21>

The opening 13 is formed in the front surface and in a central portion in the left-right direction 9 of the multifunction peripheral 10. As depicted in FIGS. 1A and 1B, the feed tray 20 is inserted/removed in the front-rear direction 8 into/from the multifunction peripheral 10, via the opening 13, by a user. As depicted in FIG. 2, the feed tray 20 can support a stacked plurality of the sheets 12. The discharge tray 21, which is disposed above the feed tray 20, is extendable independently of the feed tray 20 irrespective of the insertion and removal of the feed tray 20. The discharge tray 21 supports the sheet 12 that has been discharged from between the recording unit 24 and the platen 42 by the discharge roller unit 55.

<Feed Unit 15>

The feed unit 15 feeds to a conveyance passage 65 the sheet 12 supported by the feed tray 20. As depicted in FIG. 2, the feed unit 15 includes a feed roller 25, a feed arm 26, and a shaft 27. The feed roller 25 is rotatably supported by a distal end of the feed arm 26. Reverse rotation of a conveyance motor (not illustrated) results in the feed roller 25 rotating such that the sheet 12 is conveyed in a conveyance orientation 16. Hereafter, the feed roller 25, a conveyance roller 60, and a discharge roller 62 rotating in an orientation by which the sheet 12 is conveyed in the conveyance orientation 16 is described as "forward rotation". The feed arm 26 is pivotably supported by the shaft 27 which is supported by a frame of the printer unit 11. The feed arm 26 is forced to pivot toward the feed tray 20 by its own weight or elastic force of a spring or the like.

<Conveyance Passage 65>

Figure 3:
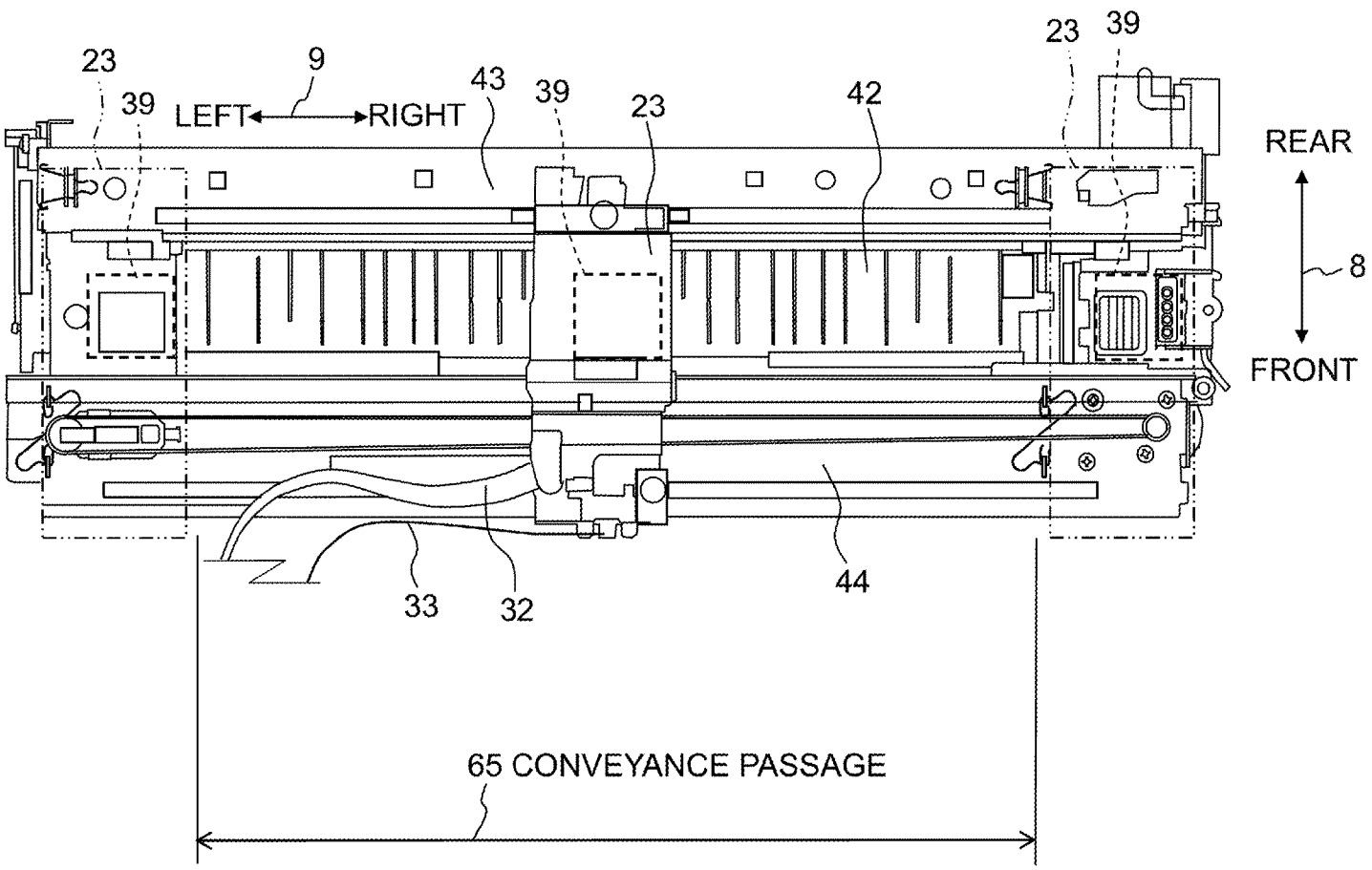
FIG. 3 is a plan view depicting an arrangement of a carriage and a platen.

As depicted in FIG. 2, the conveyance passage 65 is a passage that extends to a rear of the printer unit 11 from a rear end of the feed tray 20, makes a U-turn frontward while extending upwardly at the rear of the printer unit 11, and passes along a space between the recording unit 24 and the platen 42 to reach the discharge tray 21. Part of the conveyance passage 65 is a space formed by an outer guide member 18 and an inner guide member 19 that face each other with a certain spacing therebetween inside the printer unit 11. As depicted in FIGS. 2 and 3, a portion between the conveyance roller unit 54 and the discharge roller unit 55, of the conveyance passage 65 is provided in roughly the central portion in the left-right direction 9 of the multifunction peripheral 10, and extends in the front-rear direction 8. The conveyance orientation 16 of the sheet 12 in the conveyance passage 65 is indicated by a dot-chain line arrow in FIG. 2.

<Conveyance Roller Unit 54>

As depicted in FIG. 2, the conveyance roller unit 54 is disposed upstream in the conveyance orientation 16 of the recording unit 24. The conveyance roller unit 54 includes the conveyance roller 60 and a pinch roller 61 that face each other. The conveyance roller 60 is driven by the conveyance motor. The pinch roller 61 rotates in company with rotation of the conveyance roller 60. The sheet 12 is nipped by the pinch roller 61 and the conveyance roller 60 that forwardly rotates by forward rotation of the conveyance motor, whereby the sheet 12 is conveyed in the conveyance orientation 16.

<Discharge Roller Unit 55>

As depicted in FIG. 2, the discharge roller unit 55 is disposed downstream in the conveyance orientation 16 of the recording unit 24. The discharge roller unit 55 includes the discharge roller 62 and a spur wheel 63 that face each other. The discharge roller 62 is driven by the conveyance motor. The spur wheel 63 rotates in company with rotation of the discharge roller 62. The sheet 12 is nipped by the discharge roller 62 that forwardly rotates by forward rotation of the conveyance motor, and the spur wheel 63, whereby the sheet 12 is conveyed in the conveyance orientation 16.

<Recording Unit 24>

As depicted in FIG. 2, the recording unit 24 is disposed between the conveyance roller unit 54 and the discharge roller unit 55 in the conveyance orientation 16. The recording unit 24 is disposed so as to face the platen 42 in the up-down direction 7, sandwiching the conveyance passage 65 between itself and the platen 42. The recording unit 24 includes a carriage 23 and a recording head 39.

As depicted in FIG. 3, the carriage 23 is supported by guide rails 43, 44 that are disposed separated in the front-rear direction 8 and each provided extending in the left-right direction 9. The guide rails 43, 44 are supported by the frame of the printer unit 11. The carriage 23 is coupled to a publicly known belt mechanism provided in the guide rail 44. The belt mechanism is driven by a carriage motor (not illustrated). The carriage 23 coupled to the belt mechanism makes a reciprocating movement along the left-right direction 9 by drive of the carriage motor. A range of movement of the carriage 23 reaches to outer sides in the left-right direction 9 of the conveyance passage 65, as depicted by the dot-chain lines of FIG. 3.

Ink tubes 32 and a flexible flat cable 33 are extended out from the carriage 23.

The ink tubes 32 connect respective ink tanks 100 (an example of a tank) of the tank set 99 and the recording head 39. The ink tubes 32 supply the recording head 39 with respective inks (an example of liquid) stored in the respective ink tanks 100 of the tank set 99. Four ink tubes 32, through which black, magenta, cyan, and yellow inks flow, are provided corresponding to the respective ink tanks 100. The four ink tubes 32 are connected to the carriage 23 in a state of being bundled.

The flexible flat cable 33 electrically connects a control board on which a control unit (not illustrated) is mounted and the recording head 39. The flexible flat cable 33 transmits to the recording head 39 a control signal outputted from the control unit.

As depicted in FIG. 2, the recording head 39 is mounted in the carriage 23. Nozzles 40 are disposed in a lower surface of the recording head 39. Tips of the nozzles 40 are exposed from the lower surface of the recording head 39. The recording head 39 discharges ink from the nozzle 40 as minute ink droplets. In a process of the carriage 23 moving, the recording head 39 discharges the ink droplets toward the sheet 12 supported by the platen 42. As a result, an image is recorded on the sheet 12. Moreover, as a result, ink stored in the respective ink tanks 100 is consumed.

<Platen 42>

As depicted in FIGS. 2 and 3, the platen 42 is disposed between the conveyance roller unit 54 and the discharge roller unit 55, in relation to the conveyance orientation 16. The platen 42 is disposed so as to face the recording unit 24 in the up-down direction 7, sandwiching the conveyance passage 65 between itself and the recording unit 24. The platen 42 supports, from below, the sheet 12 conveyed by the conveyance roller unit 54.

<Cover 70>

As depicted in FIG. 1B, an opening 22 is formed in a right portion of the front wall 14A of the casing 14. A cover 70 is installed in the casing 14 so as to cover the opening 22. The cover 70 is pivotable between a closed position where the opening 22 is covered (position depicted in FIG. 1A) and an open position where the opening 22 is exposed (position depicted in FIG. 1B). A space extends rearward of the opening 22 inside of the casing 14. The tank set 99 is disposed in this space. The cover 70 includes an opening 97. When the cover 70 is in the closed position, a user can visually confirm parts of the ink tank 100 and the holding member 120 through the opening 97 from the outside.

<Tank Set 99>

Figure 4:
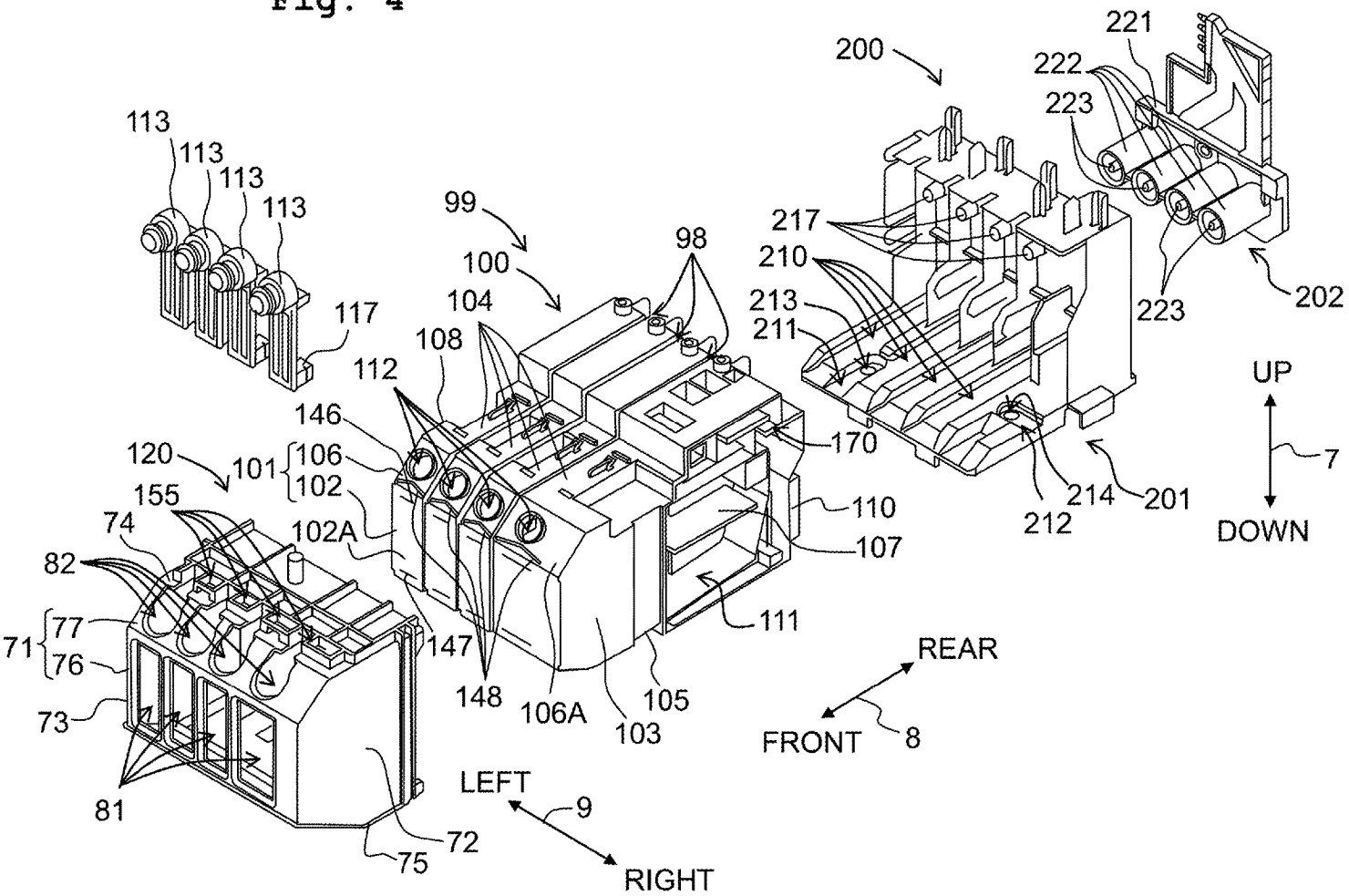
FIG. 4 is an exploded perspective view of a front portion of a tank set.
Figure 5:
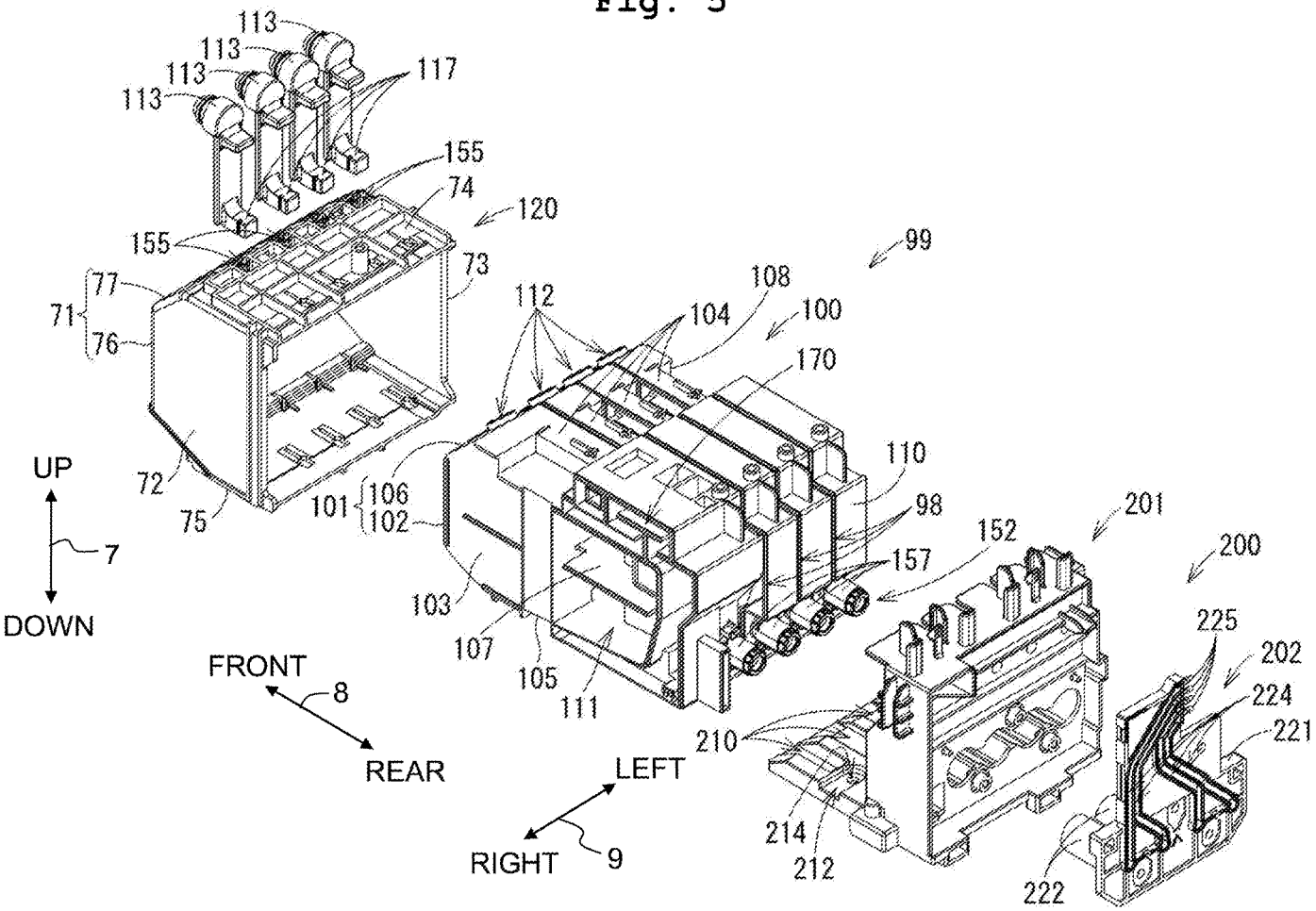
FIG. 5 is an exploded perspective view of a rear portion of the tank set.

The tank set 99 stores ink to be supplied to the recording head 39. As depicted in FIGS. 4 and 5, the tank set 99 includes the four ink tanks 100 storing different colors of inks, the holding member 120 (an example of a cover), and a coupling member 200.

The holding member 120 and the coupling member 200 hold the four ink tanks 100 in a state of being aligned along the left-right direction 9. In this embodiment, the ink tank 100 positioned at a right end has a permissible storage amount of ink which is larger than those of the other ink tanks 100. Note that a magnitude relationship of permissible storage amounts of the ink tanks 100 is not limited to the above-described example.

<Ink Tank 100>

Figure 6:
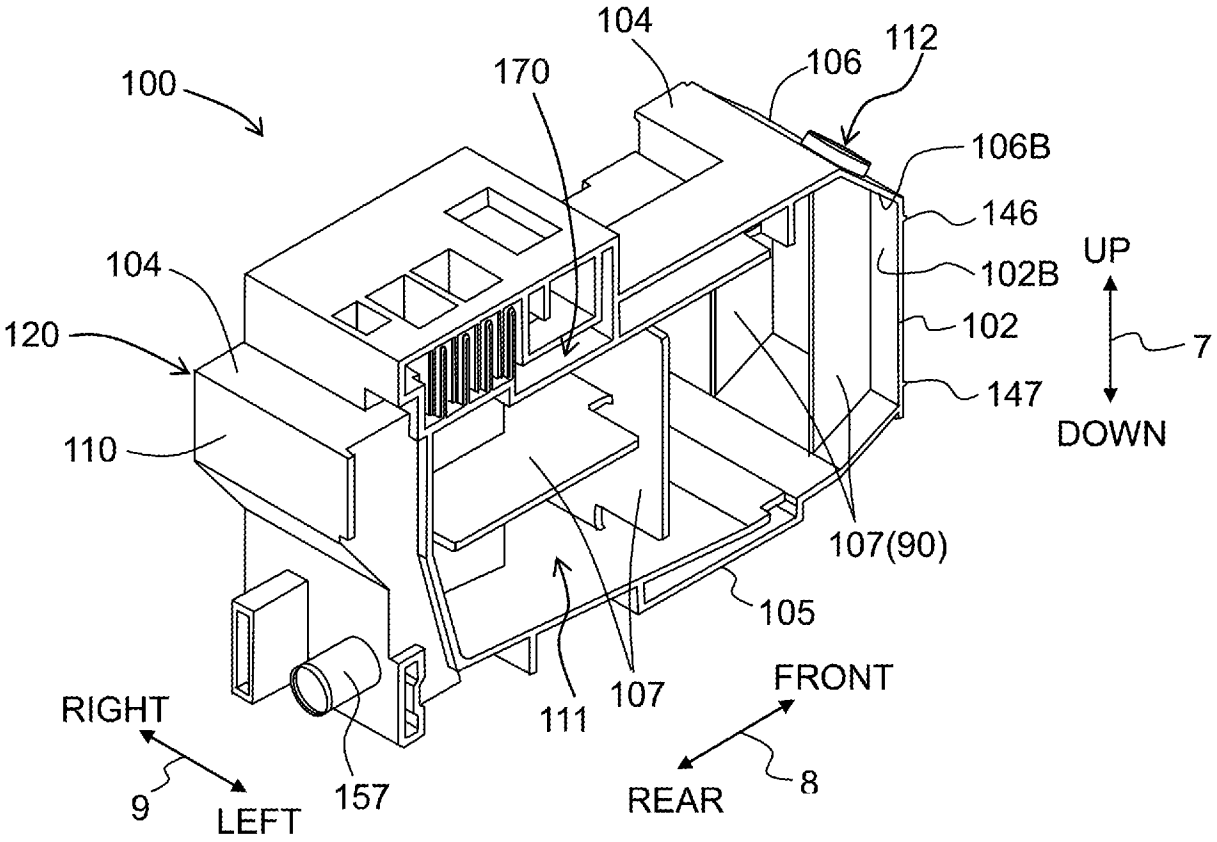
FIG. 6 is a rear perspective view of an ink tank.

As depicted in FIGS. 4 to 6, each ink tank 100 has a flat rectangular parallelepiped shape in which a dimension in the left-right direction 9 is short and dimensions in the up-down direction 7 and the front-rear direction 8 are longer than the dimension in the left-right direction 9. Moreover, the dimension in the front-rear direction 8 is longer than the dimension in the up-down direction 7. Although a side surface of each ink tank 100 is open in FIGS. 4 to 6, actually, the side surface is sealed with a film (not depicted).

Each ink tank 100 is formed from a resin having translucency to enable ink in an ink chamber 111 (an example of a storage chamber) storing the ink to be visually confirmed from the outside of the ink tank 100. Each ink tank 100 includes a front wall 101, a right wall 103, a left wall 108, an upper wall 104, a lower wall 105, a rear wall 110 (an example of a second wall), and a separating wall 107. The ink chamber 111 and an atmosphere communication passage 170 as described later are formed from the front wall 101, the right wall 103, the left wall 108, the upper wall 104, the lower wall 105, the rear wall 110, and the separating wall 107.

In this embodiment, the ink tank 100 positioned on the rightmost side among the four ink tanks 100 includes the right wall 103 at a front portion of a right side surface. A rear portion of the right side surface and a left side surface of the rightmost ink tank 100 are sealed with films. Remaining three ink tanks 100 of the four ink tanks 100 each include the left wall 108 at a front portion of a left side surface. A rear portion of the left side surface and a right side surface of each of the remaining three ink tanks 100 are sealed with films.

The front wall 101 is formed from an upright wall 102 (an example of a first wall) and an inclined wall 106 (an example of a third wall). The upright wall 102 extends in the up-down direction 7 and the left-right direction 9. The inclined wall 106 joins an upper end of the upright wall 102 and a front end of the upper wall 104. The inclined wall 106 inclines with respect to the up-down direction 7 and the front-rear direction 8. The front wall 101 forms a front end (an example of a first end) of the ink chamber 111.

A front surface 102A (an example of an outer surface) of the upright wall 102 in each of the ink tanks 100 is exposed to the outside of the multifunction peripheral 10, via the opening 97 (see FIG. 1A) of the cover 70 and an opening 81 (see FIGS. 1A and 1B) of the holding member 120. Due to there being such structure, the front surface of each of the ink tanks 100 is visually confirmable from a front of the multifunction peripheral 10, and a user can visually confirm a residual amount of ink stored in each of the ink tanks 100.

The rear wall 110 faces the front wall 101 in the front-rear direction 8. The rear wall 110 forms a rear end (an example of a second end) of the ink chamber 111.

The right wall 103 extends rearward from a right end of the front wall 101. An upper end of the right wall 103 is connected to a front portion of the upper wall 104. A lower end of the right wall 103 is connected to a front portion of the lower wall 105. The upper wall 104 extends rearward from an upper end of the front wall 101 (rear end of the inclined wall 106). The front portion of the upper wall 104 is connected to the upper end of the right wall 103. The lower wall 105 extends rearward from a lower end of the front wall 101. The lower wall 105 is formed separated downwardly from the upper wall 104. The separating walls 107 are placed in a space surrounded by the front wall 101, the right wall 103, the upper wall 104, the lower wall 105, and the rear wall 110.

The protrusion 157 protrudes rearward from the rear wall 110, in other words, to the outside of the ink tank 100. The protrusion 157 is hollow. An internal space of the protrusion 157 communicates with the ink chamber 111. An ink needle 223 of the coupling member 200 is inserted into the protrusion 157. The ink needle 223 is directly or indirectly connected to the ink tube 32. As a result, ink that has entered the internal space of the protrusion 157 from the ink chamber 111 flows out to the ink tube 32 via the ink needle 223.

Each ink tank 100 has the atmosphere communication passage 170. The atmosphere communication passage 170 communicates the ink chamber 111 and the outside of the ink tank 100.

An inlet 112 (an example of an inlet) for filling ink into the ink chamber 111 is formed in the inclined wall 106 of the ink tank 100. The inlet 112 passes through the inclined wall 106 in a thickness direction to communicate the ink chamber 111 with the outside of the ink tank 100. The inclined wall 106 and the inlet 112 are exposed to the outside of the multifunction peripheral 10 via the opening 22 (see FIG. 1B), by the cover 70 being positioned in the open position. Providing the inlet 112 in the inclined wall 106 makes it easy to supply ink into the ink tank 100 from obliquely above with respect to the inlet 112.

Figure 7:
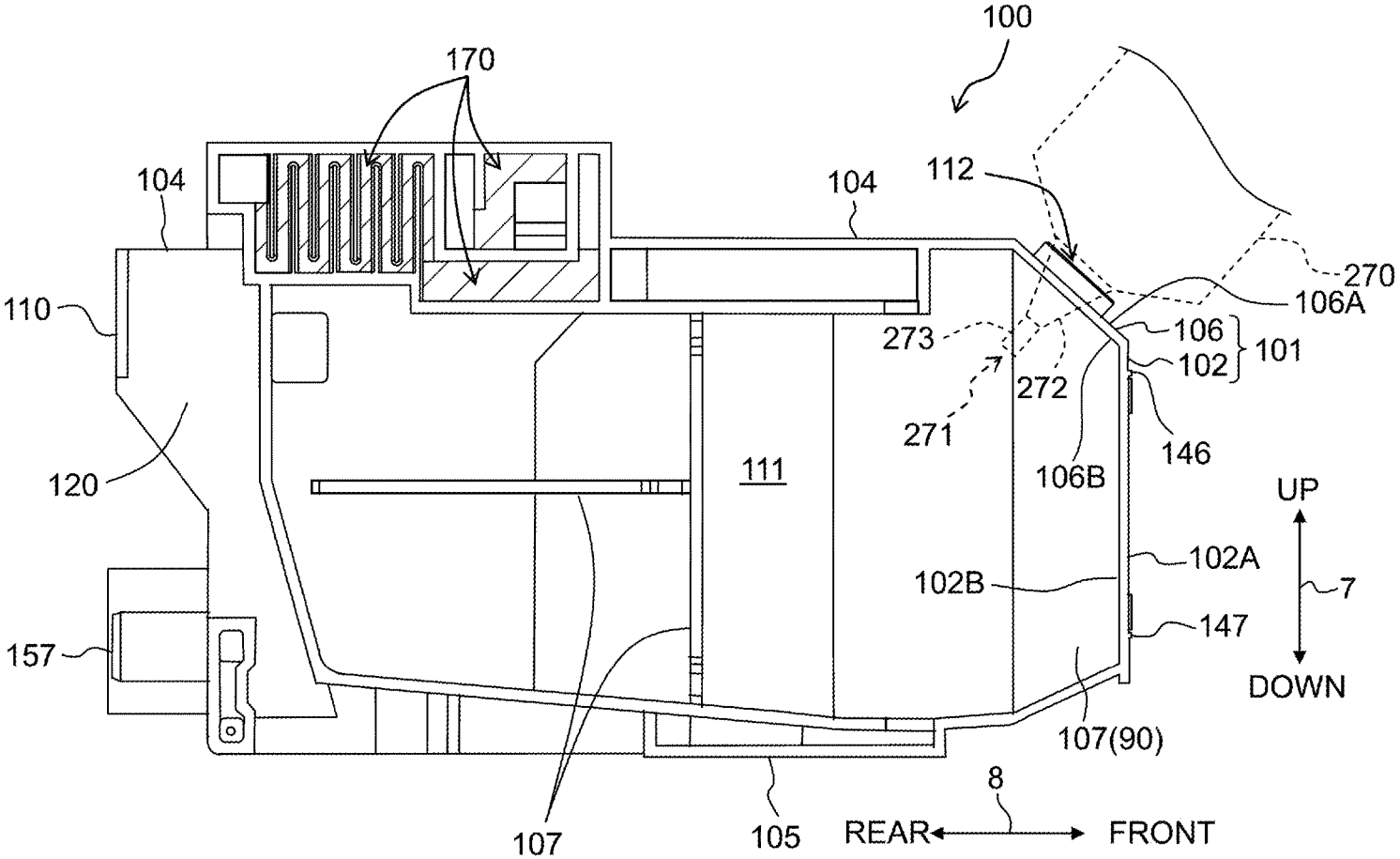
FIG. 7 is a left side view of the ink tank.

As depicted in FIG. 7, when the ink chamber 111 of the ink tank 100 is short of ink, a user supplies the ink into the ink chamber 111 from a bottle 270 (see broken lines in FIG. 7) storing the ink. The bottle 270, which has substantially a cylindrical shape, includes a tapered portion 272 of which diameter is smaller toward an injection port 271, and a nozzle 273 extending from the tapered portion 272.

As depicted in FIG. 4, the front surface 102A of the upright wall 102 of the front wall 101 includes a first line 146 and a second line 147. Each of the first line 146 and the second line 147 allows a user to confirm an amount of ink stored in the ink chamber 111. Each of the first line 146 and the second line 147 is an example of a scale.

The first line 146 (an example of an upper limit scale) extends in the left-right direction 9. A position in the up-down direction 7 of the first line 146 is at the same height as the liquid surface of the ink when the maximum permissible storage amount of ink has been stored in the ink chamber 111 in the usable posture of the multifunction peripheral 10. Namely, the first line 146 is provided at a position corresponding to the liquid surface of the ink when the maximum permissible storage amount of ink has been stored in the ink chamber 111. In other words, the first line 146 indicates an upper limit of the ink stored in the ink chamber 111.

The second line 147 (an example of a lower limit scale) extends in the left-right direction 9. The second line 147 is positioned more downwardly than the first line 146. In detail, a position in the up-down direction 7 of the second line 147 is at the same height as a liquid surface of the ink when an amount less than the above-described maximum amount of ink has been stored in the ink chamber 111, in the usable posture of the multifunction peripheral 10. In this embodiment, the position in the up-down direction 7 of the second line 147 is at the same height as a liquid surface of the ink when ink of a minimum amount at which replenishment of ink becomes required, has been stored in the ink chamber 111, in the usable posture of the ink tank 100. In other words, the second line 147 is provided at a position corresponding to the liquid surface when ink stored in the ink chamber 111 is of the minimum amount. In other words, the second line 147 indicates a lower limit of the ink stored in the ink chamber 111.

As depicted in FIG. 8, the first line 146 is formed by a non-offset portion 146A that is in the same position as the inlet 112 in the left-right direction 9 and offset portions 146B that are in positions different from the inlet 112 in the left-right direction 9. The second line 147 is formed by a non-offset portion 147A that is in the same position as the inlet 112 in the left-right direction 9 and offset portions 147B that are at positions different from the inlet 112 in the left-right direction 9.

Figure 9A:
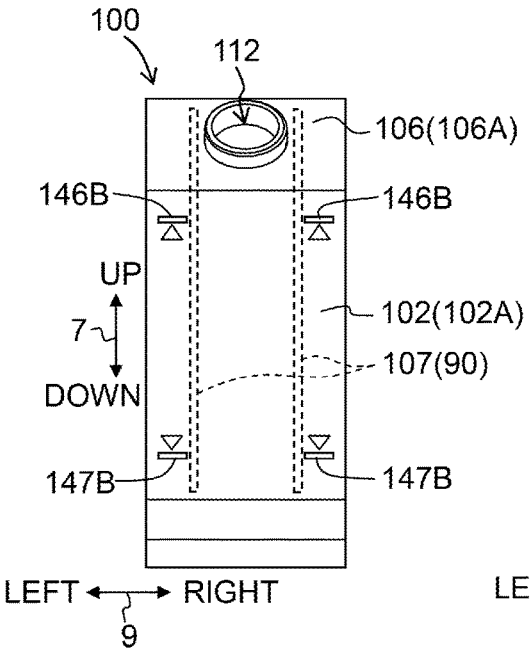
FIGS. 9A to 9C are front views of other modified examples of the ink tank according to the first embodiment of the present teaching.
Figure 9B:
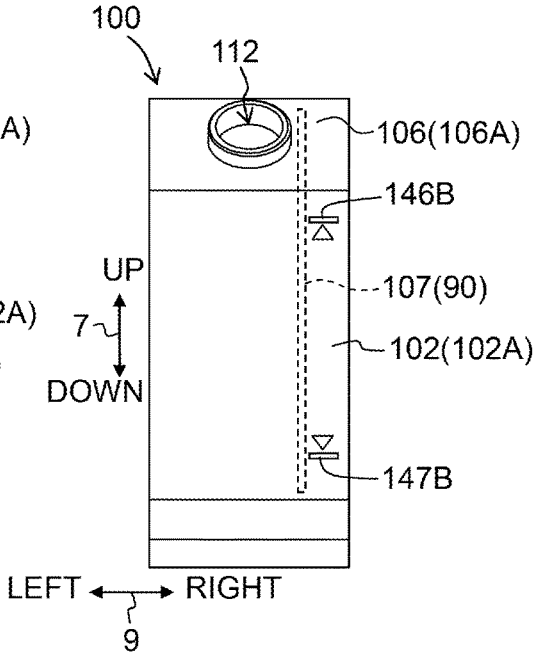

As depicted in FIG. 9A, the first line 146 may be formed only by the offset portions 146B and the second line 147 may be formed only by the offset portions 147B. Although two of the offset portions 146B and two of the offset portions 147B are formed in FIG. 9A, the number of offset portions 146B and 147B are not limited to two. For example, as depicted in FIG. 9B, the single offset portion 146B and the single offset portion 147B may be formed in the ink tank 100. Or, as depicted in FIGS. 11A to 11D, the first line 146 may be formed only by the non-offset portion 146A and the second line 147 may be formed only by the non-offset portion 147A.

The position in the up-down direction 7 of the first line 146 is not limited to being at the same height as the liquid surface of the ink when said maximum amount of ink has been stored in the ink chamber 111. The position in the up-down direction 7 of the second line 147 is not limited to being at the same height as the liquid surface of the ink when said minimum amount of ink has been stored in the ink chamber 111. Only one of the first line 146 and the second line 147 may be formed in the front surface 102A of the upright wall 102 of the front wall 101. Another line may be formed at a position different from those of the first line 146 and the second line 147.

The scale for allowing a user to confirm an amount of ink stored in the ink chamber 111 may be any scale that allows a user to confirm an amount of ink stored in the ink chamber 111. The scale is not limited to those having a line shape, such as the first line 146 and the second line 147 depicted in FIG. 4.

As depicted in FIG. 4, the inclined wall 106 of the front wall 101 of each ink tank 100 includes a rib 148 protruding from the front surface 106A. In the drawings in which the inclined wall 106 is depicted, except for FIG. 4, the illustration of the rib 148 is omitted.

Each rib 148 is formed below the inlet 112. The rib 148 extends substantially in the left-right direction 9 from the vicinity of a right end of the front surface 106A to the vicinity of a left end of the front surface 106A. Specifically, the rib 148 extends leftward and upward from the vicinity of the right end to its center in the left-right direction 9, and extends leftward and downward from its center in the left-right direction 9 to the vicinity of the left end.

If ink leaks from the inlet 112 during its supply into the ink chamber 111 through the inlet 112, the rib 148 provided in the front surface 106A of the front wall 106 prevents the leaking ink from adhering to the front surface 106A of the front wall 102, especially, a portion of the front surface 106A below the first line 146. Further, since the rib 148 is inclined, the ink adhering to the rib 148 from above is guided to the outer sides of the ink tank 100 in the left-right direction 9. Those reduce the possibility that the ink adheres to the front wall 106, decreasing a situation in which a user has difficulty in visually confirming the ink in the ink chamber 111 due to the ink adhering to the front surface 106A of the front wall 106.

Each rib 148 may have any shape provided that the above effects can be obtained, without being limited to the shape depicted in FIG. 4. For example, each rib 148 may be shorter than that depicted in FIG. 4 in the left-right direction 9. In that case, the rib 148 preferably extends from a position on the right side of the right ends of the first line 146 and the second line 147 to a position on the left side of the left ends of the first line 146 and the second line 147. Further, for example, the rib 148 may extend straight in the left-right direction 9, may extend downward and rightward from its left end, or may extend downward and leftward from its right end.

The position of each rib 148 is not limited to that depicted in FIG. 4, provided that the above effects can be obtained. For example, the rib 148 may be formed in the front wall 101 instead of the inclined wall 106. In that case, the rib 148 is preferably formed above the first line 146.

As depicted in FIGS. 6 and 7, the partitioning walls 107 include two partitioning walls 90 (an example of an inner wall). The two partitioning walls 90 extend rearward from an inner surface 102B of the upright wall 102 and an inner surface 106B of the inclined wall 106.

Figure 14A:
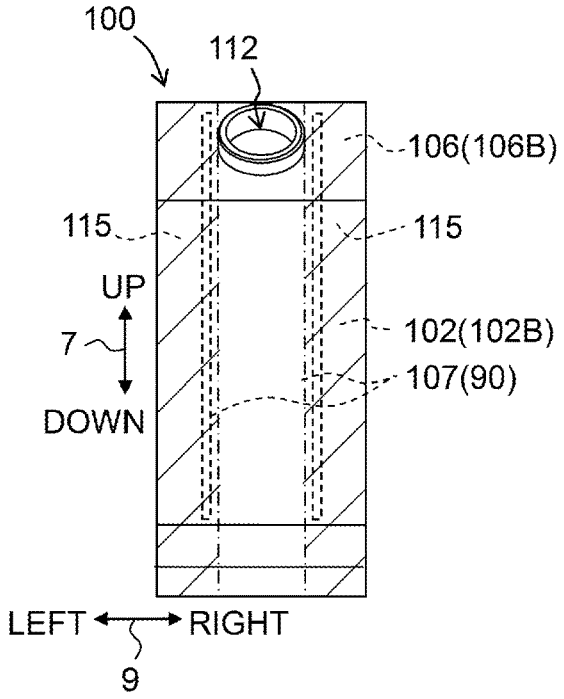
FIGS. 14A and 14B are front views each depicting an ink tank in which neither first line and nor second line are formed.
Figure 14B:
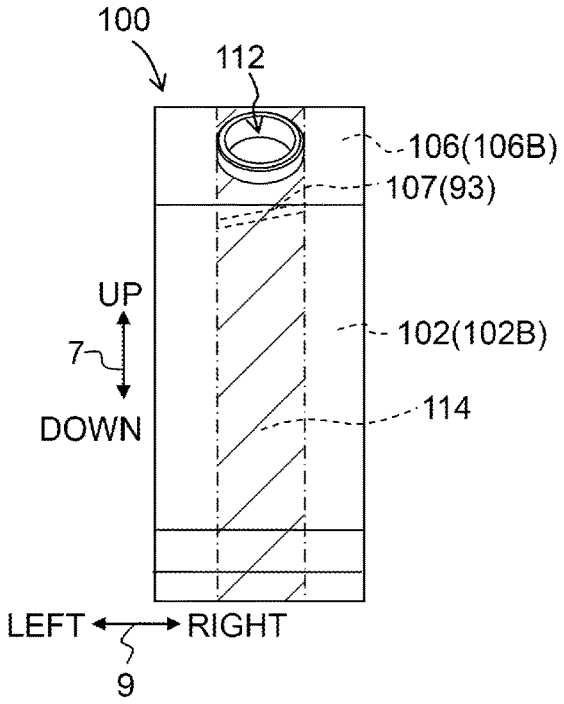

As depicted in FIGS. 14A and 14B, the inner surfaces 102B and 106B include a non-offset area 114 (see FIG. 14B) and two offset areas 115 (see FIG. 14A) sandwiching the non-offset area 114 therebetween in the left-right direction 9. In the left-right direction 9, the position of the non-offset area 114 is the same as that of the inlet 112. In the left-right direction 9, the position of each offset area 115 is different from that of the inlet 112. The non-offset portions 146A and 147A (see FIG. 8A) are formed in a part, of the front surface 102A of the upright wall 102 of the front wall 101, corresponding to the non-offset area 114 (in other words, an area on the reverse side of the non-offset area 114). The offset portions 146B and 147B (see FIG. 8A) are formed in parts, of the front surface 102A of the upright wall 102 of the front wall 101, corresponding to the offset areas 115 (in other words, areas on the reverse side of the non-offset areas 115).

As depicted in FIG. 7, each partitioning wall 90 extends rearward beyond a rear end of the inlet 112.

Figure 8A:
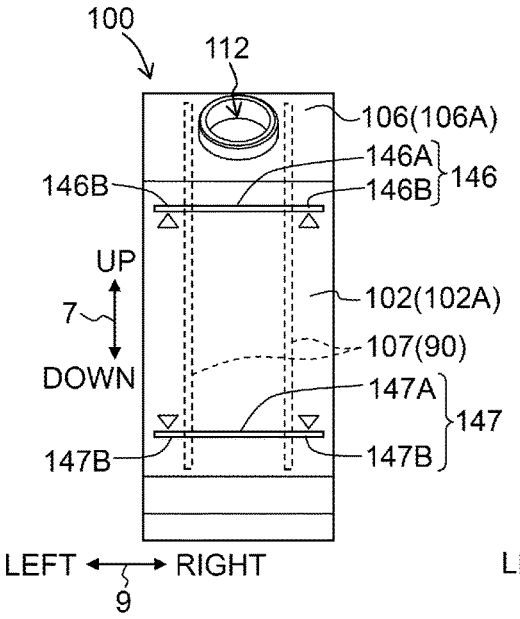
FIG. 8A is a front view depicting the ink tank according to a first embodiment of the present teaching and FIGS. 8B to 8D are modified examples of the ink tank.
Figure 8B:
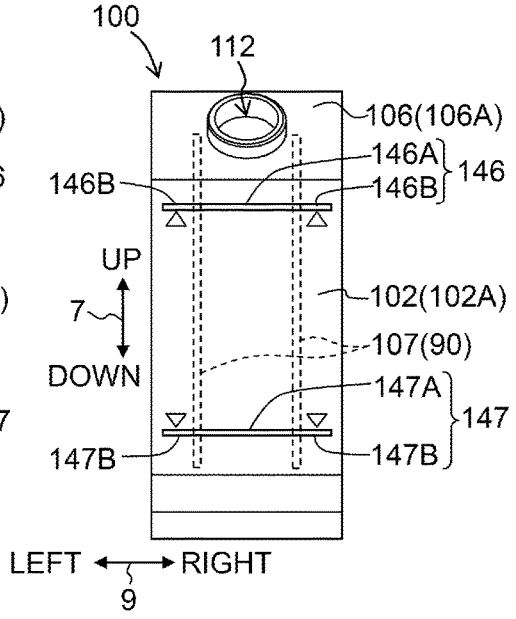
Figure 8C:
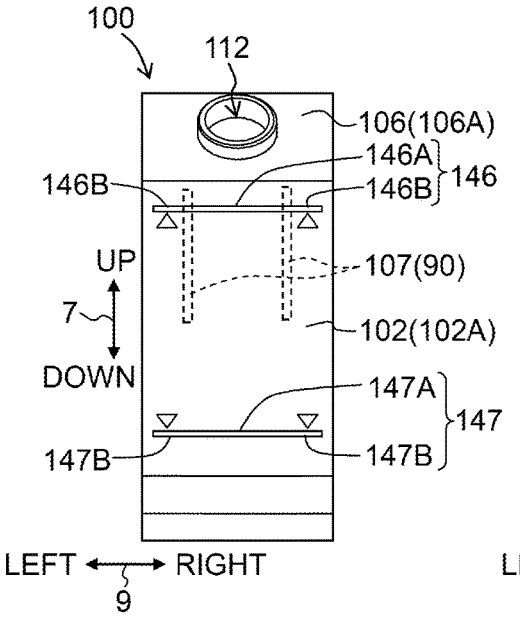
Figure 8D:
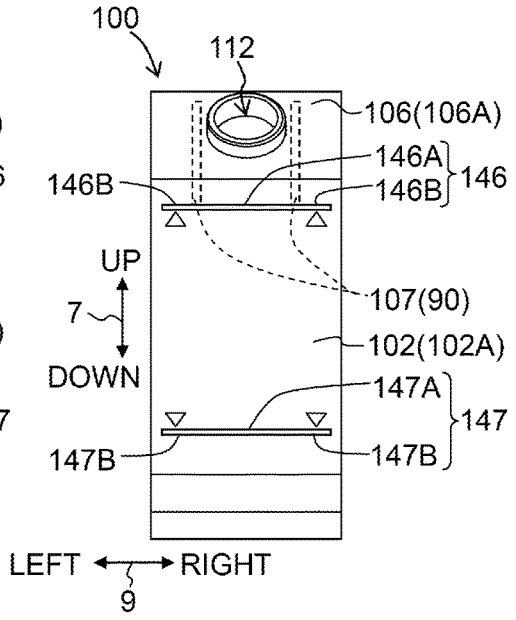

As depicted in FIG. 8A, the partitioning walls 90 are formed on the right and left sides of the inlet 112 in the left-right direction 9. The partitioning walls 90 separate the inlet 112 from the offset portions 146B and 147B in the left-right direction 9. Namely, the partitioning wall 90 on the right side is positioned, in the left-right direction 9, between the inlet 112 and the offset portions 146B, 147B on the right side, and the partitioning wall 90 on the left side is positioned, in the left-right direction 9, between the inlet 112 and the offset portions 146B, 147B on the left side.

As depicted in FIG. 8A, each partitioning wall 90 extends from a position above the first line 146 in the up-down direction 7 (in other words, a position above upper ends of the non-offset portion 146A and the offset portions 146B) beyond a position below a lower end of the second line 147 in the up-down direction 7 (in other words, a position below lower ends of the non-offset portion 147A and the offset portions 147B). In this embodiment, an upper end of each partitioning wall 90 is positioned above the inlet 112. Further, the partitioning wall 90 extends in the up-down direction 7.

<Holding Member 120>

As depicted in FIGS. 4 and 5, the holding member 120 holds the four ink tanks 100 from the front in the front-rear direction 8, in a state of being aligned in the left-right direction 9. The holding member 120 includes a front wall 71, a right wall 72, a left wall 73, an upper wall 74, and a lower wall 75. The front wall 71 is formed by an upright wall 76 and an inclined wall 77. The upright wall 76 extends in the up-down direction 7 and the left-right direction 9. The inclined wall 77 joins an upper end of the upright wall 76 and a front end of the upper wall 74. The inclined wall 77 is inclined in the up-down direction 7 and the front-rear direction 8.

The right wall 72 extends rearward from a right end of the front wall 71. The left wall 73 extends rearward from a left end of the front wall 71. The upper wall 74 extends rearward from an upper end of the front wall 71 (more specifically, an upper end of the inclined wall 77). A right end of the upper wall 74 is connected to an upper end of the right wall 72. A left end of the upper wall 74 is connected to an upper end of the left wall 73. The lower wall 75 extends rearward from a lower end of the front wall 71. A right end of the lower wall 75 is connected to a lower end of the right wall 72. A left end of the lower wall 75 is connected to a lower end of the left wall 73.

In a state where the four ink tanks 100 are positioned in the left-right direction 9 with respect to the holding member 120, a gap 98 is formed between adjacent ink tanks 100. In a state where the holding member 120 holds the four ink tanks 100, the front wall 71 covers the front walls 101 of the four ink tanks 100, the upper wall 74 covers front portions of the upper walls 104 of the four ink tanks 100, and the lower wall 75 covers front portions of the lower walls 105 of the four ink tanks 100.

In the state where the holding member 120 holds the four ink tanks 100, the right wall 72 covers a front portion of a right surface of the ink tank 100 disposed on the rightmost side among the four ink tanks 100, and the left wall 73 covers a front portion of a left surface of the ink tank 100 disposed on the leftmost side among the four ink tanks 100. As described above, the holding member 120 in a state of holding the four ink tanks 100 covers the front portions of the four ink tanks 100.

Openings 81 are formed in the upright wall 76 of the front wall 71 of the holding member 120. The openings 81 are formed at intervals in the left-right direction 9. In this embodiment, four of the openings 81 are formed corresponding to the four ink tanks 100, respectively. The number of openings 81 is not limited to four. In this embodiment, a shape of each of the openings 81 is a rectangle, but may be other than a rectangle.

In the state where the holding member 120 holds the respective ink tanks 100, the upright wall 102 of the front wall 101 of each of the ink tanks 100 can be exposed to the outside of the holding member 120 via the opening 81. In detail, the front surface 102A of the upright wall 102 and the first line 146 and second line 147 formed on said front surface 102A, can be exposed. Further, in a state where the holding member 120 holds the respective ink tanks 100 and where the cover 70 is in the closed position, the upright wall 102 of each of the ink tanks 100 can be exposed to the outside of the printer unit 11 via the opening 81 of the holding member 120 and the opening 97 of the cover 70 (see FIG. 1A). Namely, a user can visually confirm the inside of the ink tank 100 and a residual amount of ink in the ink tank 100 from the outside of the ink tank 100.

Openings 82 are formed in the inclined wall 77 of the front wall 71 of the holding member 120. The openings 82 are formed at intervals in the left-right direction 9. In this embodiment, four of the openings 82 are formed corresponding to the four ink tanks 100, respectively. In this embodiment, a shape of each of the openings 82 is a circle, but may be other than a circle. In the state where the holding member 120 holds the respective ink tanks 100, the inlet 112 of each of the ink tanks 100 can be exposed to the outside of the holding member 120 via the opening 82.

Caps 113 are attached to a front portion of the upper wall 74 of the holding member 120. Each of the caps 113 is molded by a material capable of elastic deformation such as rubber or elastomer. Each of the caps 113 is attached to the holding member 120 by fitting an attaching section 117 of the cap 113 into a cap attachment section 155 of the upper wall 74.

Each cap 113 seals the inlet 112 in a liquid-tight manner (see FIG. 1B) by fitting a front end of the cap 113 attached to the holding member 120 into the inlet 112. Detaching the front end of the cap 113 from the inlet 112 opens the inlet 112. In that state, ink can be supplied into the ink chamber 111 through the inlet 112.

<Coupling Member 200>

As depicted in FIGS. 4 and 5, the four ink tanks 100 are installed in the coupling member 200. The coupling member 200 holds the four ink tanks 100 from the rear in the front-rear direction 8, in a state of being aligned in the left-right direction 9. The coupling member 200 has a supporting main body 201 and a coupling section 202. The coupling member 200 is formed by the coupling section 202 being combined from a rear of the supporting main body 201. Note that in this embodiment, the supporting main body 201 and the coupling section 202 are formed as separate members, but the supporting main body 201 and the coupling section 202 may be formed integrally.

Four grooves 210 extending in the front-rear direction 8 are formed in an upper surface of the supporting main body 201. A front end of each of the grooves 210 opens frontward. Width in the left-right direction 9 of each of the grooves 210 is larger than width in the left-right direction 9 of one of the four ink tanks 100 corresponding thereto. When the four ink tanks 100 integrally held in the holding member 120 are coupled to the coupling member 200, each of the grooves 210 positions the corresponding one of the ink tanks 100 in the left-right direction 9 and functions as a guide to allow the corresponding one of the ink tanks 100 to slide in the front-rear direction 8.

Two recesses 211 and 212 are formed in the supporting main body 201 at positions not overlapping the grooves 210. The recesses 211 and 212 are at positions separated in the left-right direction 9. Through holes 213 and 214 passing through the supporting main body 201 in the up-down direction 7 are respectively formed in the recesses 211 and 212. Screws inserted in the through holes 213 and 214 are screwed into screw holes of the casing 14 and heads of the screws abut against the recesses 211 and 212, whereby the supporting main body 201 is fixed to the casing 14.

Four rods 217 protruding frontward are respectively provided above the four grooves 210 of the supporting main body 201. The rear wall 110 of each of the ink tanks 100 abuts against a front end of each of the rods 217, whereby a rearward position of each of the ink tanks 100 is determined.

The coupling section 202 has a coupling plate 221, four guide tubes 222, the four ink needles 223, four ink flow paths 224, and four joints 225. The coupling plate 221 is fixed to the supporting main body 201 by a screw (not depicted).

Each of the guide tubes 222 has a cylindrical shape protruding frontward from the coupling plate 221. The four guide tubes 222 are positioned above the four grooves 210. The four guide tubes 222 are aligned in the left-right direction 9 respectively corresponding to the four grooves 210. Each of the guide tubes 222 is capable of housing in its internal space the protrusion 157 of each of the ink tanks 100. When each of the ink needles 223 is inserted into the protrusion 157 of each of the ink tanks 100, each of the guide tubes 222 houses the protrusion 157 to position the ink needle 223 and the protrusion 157.

The ink needle 223 is disposed in the internal space of each of the guide tubes 222 so as to be coaxial with the guide tube 222. The ink needle 223 is a tube extending frontward from the coupling plate 221. By the ink needle 223 being inserted into the protrusion 157 of the ink tank 100, the internal space of the ink needle 223 communicates with the ink chamber 111 of the ink tank 100.

The four ink flow paths 224 are formed on a rear surface of the coupling plate 221. The four ink flow paths 224 are formed as independent flow paths respectively corresponding to the four ink needles 223. An opening surface (rear surface) formed in the rear surface of the coupling plate 221 is sealed by an unillustrated film, whereby the ink flow path 224 is formed. Each of the ink flow paths 224 is continuous with an opening at a rear end of each of the ink needles 223. Moreover, each of the four ink flow paths 224 is continuous with one of the joints 225 formed in an upper portion of the coupling plate 221. One of the ink tubes 32 is coupled to each of the joints 225. An ink flow path communicating from the ink chamber 111 of each of the ink tanks 100 to each of the ink tubes 32 is formed by the coupling section 202. As described above, the rear end of each of the ink needles 223 is connected to the recording unit 24 via the ink flow path 224, the joint 225, and the ink tube 32.

<Modified Examples of the First Embodiment>

The position of the rear end of each partitioning wall 90 is not limited to the position depicted in FIG. 7. For example, the partitioning wall 90 may extend rearward beyond a front end (injection port 271) of the nozzle 273 of the bottle 270 inserted into the inlet 112. Or, for example, the partition wall 90 may extend to the rear end of the ink chamber 111 to be connected to the rear wall 110.

In the above embodiment, the two partitioning walls 90 are formed on the right and left sides of the inlet 112. However, the two partitioning walls 90 may be formed on only one of the right and left sides of the inlet 112.

The formation range of each partitioning wall 90 in the up-down direction 7 is not limited to the range from a position above the inlet 112 to a position below the lower end of the second line 147. For example, the upper end of the partitioning wall 90 may be positioned between the upper end and the lower end of the inlet 112 (see FIG. 8B), or between the lower end of the inlet 112 and the upper end of the first line 146 (see FIG. 8C). Further, for example, the lower end of the partitioning wall 90 may be positioned between the lower end of the inlet 112 and the upper end of the first line 146 (see FIG. 8D), or between the first line 146 and the second line 147 (see FIG. 8C). It is needless to say that the lower end of the partitioning wall 90 is positioned below the upper end of the partitioning wall 90.

In the above embodiment, each partitioning wall 90 extends rearward from the inner surface 102B of the upright wall 102 and the inner surface 106B of the inclined wall 106. However, depending on the formation range of the partitioning wall 90 in the up-down direction 7, the partitioning wall 90 may extend rearward only from the inner surface 102B of the upright wall 102. Or, the partitioning wall 90 may extend rearward only from the inner surface 106B of the inclined wall 106. Namely, each partitioning wall 90 may extend rearward from at least one of the inner surface 102B of the upright wall 102 and the inner surface 106B of the inclined wall 106.

In the above embodiment, each partitioning wall 90 extends in the up-down direction 7. The partitioning wall 90, however, is only required to extend in a direction having a component of the up-down direction 7. Namely, each partitioning wall 90 may be inclined to the up-down direction 7 (e.g., see FIG. 9C).

Figure 9C:
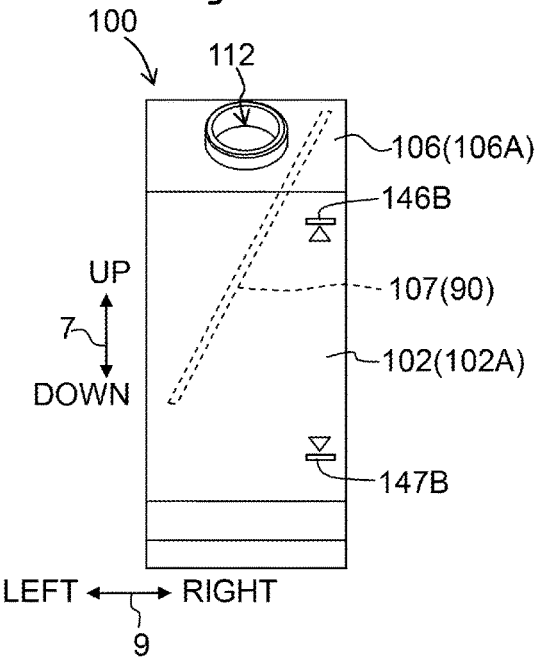

In the above embodiment, the partitioning wall 90 is entirely positioned between the inlet 112 and the offset portions 146B, 147B in the left-right direction 9. The partitioning wall 90, however, may be partially positioned between the inlet 112 and the offset portions 146B, 147B in the left-right direction 9 (e.g., see FIG. 9C). In FIG. 9C, a part of the partitioning wall 90 is positioned between the inlet 112 and the offset portions 146B, 147B in the left-right direction 9. A left end of the partitioning wall 90 is at a position different from those of the inlet 112 and the offset portions 146B, 147B in the left-right direction 9. A center of the partitioning wall 90 is at the same position as the inlet 112 in the left-right direction 9.

As depicted in FIGS. 10A to 10D, in addition to the partitioning wall 90, a partitioning wall 91 (an exemplary sub-inner wall) may be formed as one of the partitioning walls 107 extending rearward from at least one of the inner surface 102B of the upright wall 102 and the inner surface 106B of the inclined wall 106.

The partitioning wall 91 extends rearward to the same position as the partitioning wall 90. The partitioning wall 91 may extend rearward to a position different from that of the partitioning wall 90.

Figure 10A:
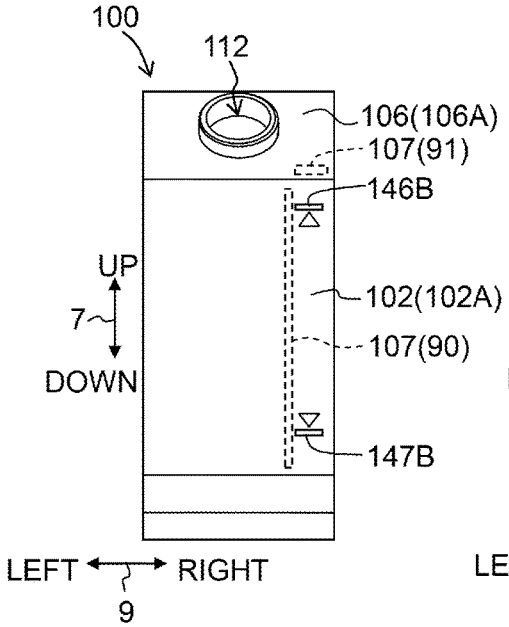
FIGS. 10A to 10D are front views of still other modified examples of the ink tank according to the first embodiment of the present teaching.

As depicted in FIG. 10A, the partitioning wall 91 is formed between the inlet 112 and the offset portion 146B in the up-down direction 7. The partitioning wall 91 extends in the left-right direction 9.

The partitioning wall 91 is only required to extend in a direction having a component of the left-right direction 9. Namely, the partitioning wall 91 may be inclined to the left-right direction 9 (e.g., see FIG. 10B). When the partitioning wall 91 is inclined to the left-right direction 9, the extending range of the partitioning wall 91 in the up-down direction 7 is not limited to a position between the inlet 112 and the offset portion 146B. For example, as depicted in FIG. 10C, the partitioning wall 91 extends from a position above the lower end of the inlet 112 to a position below the offset portion 146B.

In FIG. 10A, the partitioning wall 91 is formed in the same position as the offset portion 146B in the left-right direction 9. For example, as depicted in FIG. 10C, the partitioning wall 91 may extend, in the left-right direction 9, to a position different from that of the offset portion 146B.

Figure 10B:
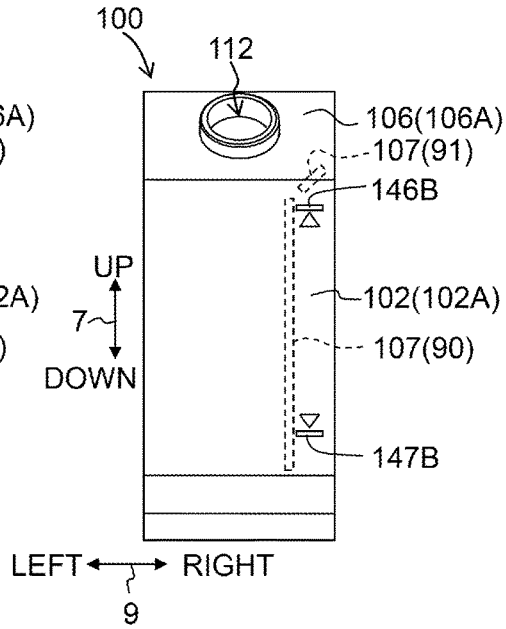
Figure 10C:
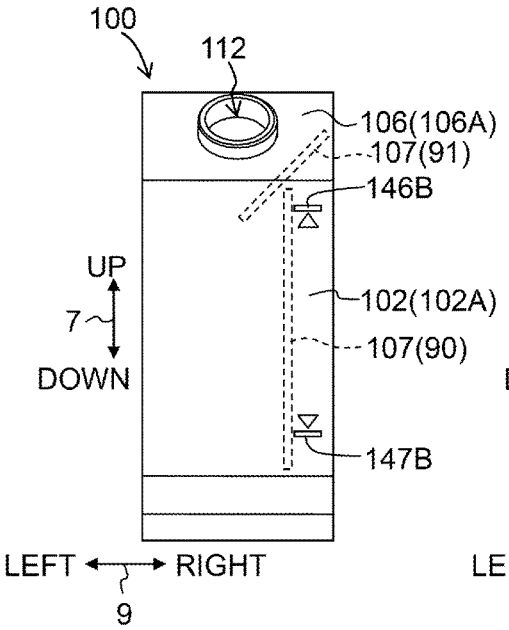
Figure 10D:
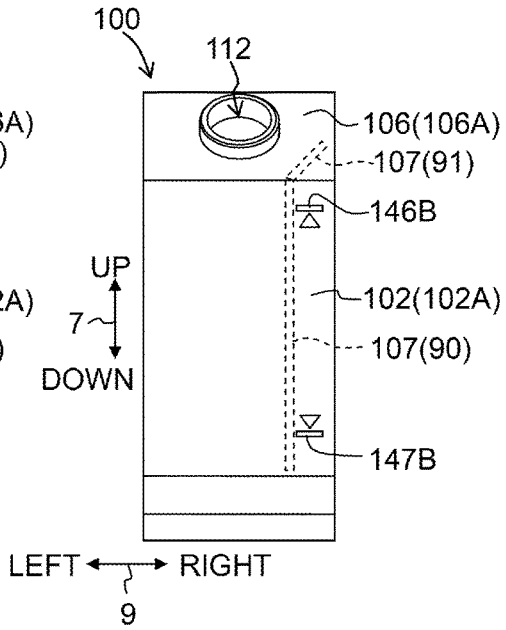

As depicted in FIGS. 10A to 10C, the partitioning wall 91 may be formed to be separated from the partitioning wall 90. Or, as depicted in FIG. 10D, the partitioning wall 91 may be connected to the partitioning wall 90.

<Function and Effect of the First Embodiment>

In the first embodiment, the partitioning wall 90 is positioned between the inlet 112 and the offset portions 146B, 147B in the left-right direction 9 (e.g., see FIG. 8A). In that configuration, when the ink supplied from the inlet 112 flows or is scattered in the left-right direction 9, it is possible to reduce the adhesion of ink to areas, of the inner surface 102B of the upright wall 102, corresponding to the offset portions 146B and 147B and peripheries thereof. This allows a user to accurately confirm an amount of ink stored in the ink tank 100 from the outside.

In the first embodiment, each partitioning wall 90 extends to a position below the upper ends of the offset portions 146B and 147B (e.g., see FIG. 8A). Thus, unlike a configuration in which each partitioning wall 90 is formed only above the upper ends of the offset portions 146B and 147B, the configuration of the first embodiment can reduce the adhesion of ink to areas, of the inner surface 102B of the upright wall 102, corresponding to the offset portions 146B and 147B and peripheries thereof.

In the first embodiment, each partitioning wall 90 extends downward beyond the lower ends of the offset portions 146B and 147B (e.g., see FIG. 8A). Thus, unlike a configuration in which each partitioning wall 90 is formed only above the lower ends of the offset portions 146B and 147B, the configuration of the first embodiment can reduce the adhesion of ink to areas, of the inner surface 102B of the upright wall 102, corresponding to the offset portions 146B and 147B and peripheries thereof.

In the first embodiment, each partitioning wall 90 extends to a position above the inlet 112 (e.g., see FIG. 8A). This can prevent the ink supplied from the inlet 112 from flowing or being scattered in the left-right direction 9.

In the first embodiment, each partitioning wall 90 extends in the up-down direction 7 (e.g., see FIG. 8A). This reduces the size of each partitioning wall 90 in the left-right direction 9, thus making it possible to shorten the ink tank 100 in the left-right direction 9.

The ink supplied from the inlet 112 may flow or be scattered above each partitioning wall 90 and adhere to an outer side of each partition wall 90 in the left-right direction 9. In that case, the ink may adhere, from above, to areas, of the inner surface 102B of the upright wall 102, corresponding to the offset portions 146B and 147B and peripheries thereof. In the first embodiment, the partitioning wall 91 (see FIGS. 10A to 10D) can reduce the adhesion of ink from above.

In the first embodiment, the partitioning wall 91 extends beyond the offset portions 146B and 147B in the left-right direction 9 (e.g., see FIG. 10C). Thus, unlike a configuration in which the partitioning wall 91 is formed only immediately above the offset portions 146B and 147B, it is possible to reduce the adhesion of ink to areas, of the inner surface 102B of the upright wall 102, corresponding to the offset portions 146B and 147B and peripheries thereof.

In the first embodiment, the partitioning wall 91 is connected to the partitioning wall 90 (e.g., see FIG. 10D). Thus, there is no gap between the partitioning wall 90 and the partitioning wall 91, preventing ink from passing therethrough. This makes it possible to reduce the adhesion of ink to areas, of the inner surface 102B of the upright wall 102, corresponding to the offset portions 146B and 147B and peripheries thereof.

<Second Embodiment>

In the following, the second embodiment of the present teaching is explained. In the first embodiment, the partitioning walls 90 and 91, included in the partitioning walls 107, extend rearward from at least one of the inner surface 102B of the upright wall 102 and the inner surface 106B of the inclined wall 106. In the second embodiment, however, partitioning walls 93 and 94, included in the partitioning walls 107, extend rearward from at least one of the inner surface 102B of the upright wall 102 and the inner surface 106B of the inclined wall 106. Any other configurations than the partitioning walls extending rearward from the inner surface 102B and/or the inner surface 106B are the same as those of the first embodiment. In the second embodiment, the partitioning walls 93 and 94, which are different from the partitioning walls in the first embodiment, are explained mainly below, and any other configurations which are the same as those of the first embodiment are not explained.

Figure 11A:
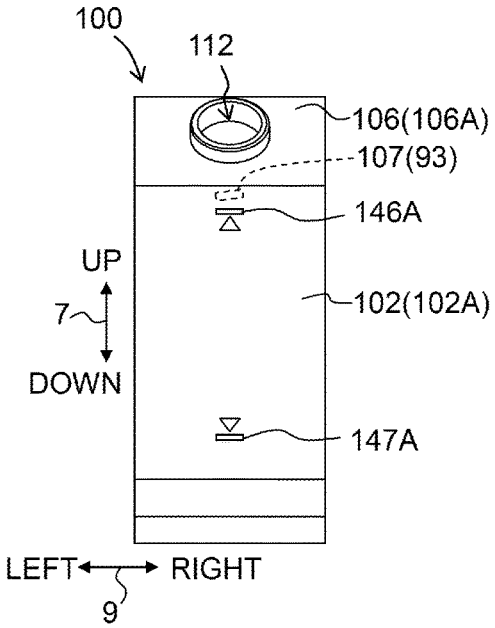
FIG. 11A is a front view depicting an ink tank according to a second embodiment of the present teaching and FIGS. 11B to 11D are modified examples of the ink tank.

In the second embodiment, as depicted in FIG. 11A, the first line 146 may be formed only from the non-offset portion 146A, and the second line 147 may be formed only from the non-offset portion 147A. In the following, an arrangement of the partitioning wall 93 (an exemplary inner wall) when the first line 146 is formed only from the non-offset portion 146A and the second line 147 is formed only from the non-offset portion 147A is explained. Further, an arrangement of the partitioning walls 94 (an exemplary sub-inner wall) when the first line 146 is formed only from the non-offset portion 146A and the second line 147 is formed only from the non-offset portion 147A is explained in a modified example of the second embodiment. It is needless to say that the partitioning walls 93 and 94 may be arranged when the first line 146 is formed from the non-offset portion 146A and the offset portions 146B and the second line 147 is formed from the non-offset portion 147A and the offset portions 147B.

As depicted in FIGS. 11A to 12D, similar to the partitioning walls 90 and 91, the partitioning walls 93 and 94 extend rearward from at least one of the inner surface 102B of the upright wall 102 and the inner surface 106B of the inclined wall 106.

As depicted in FIG. 11A, the partitioning wall 93 is disposed at a position separating the inlet 112 from the non-offset portions 146A and 147A in the up-down direction 7. Namely, the partitioning wall 93 is positioned between the inlet 112 and the non-offset portions 146A, 147A in the up-down direction 7. Although the partitioning wall 93 extends from the inner surface 102B of the upright wall 102 in FIG. 11A, the partitioning wall 93 may extend from the inner surface 106B of the inclined wall 106.

The partitioning wall 93 extends in a direction having a component of the left-right direction 9. Namely, the partitioning wall 93 is inclined to the left-right direction 9. In FIG. 11A, the partitioning wall 93 extends, in the left-right direction 9, from a left end (an exemplary first end) to a right end (an exemplary second end) of the non-offset portions 146A and 147A.

<Modified Example of the Second Embodiment>

In the second embodiment, the partitioning wall 93 extends in the left-right direction 9 from the left end to the right end of the non-offset portions 146A and 147A. However, at least a part of the partitioning wall 93 may extend from the left end to the right end of the non-offset portions 146A and 147A.

Figure 11B:
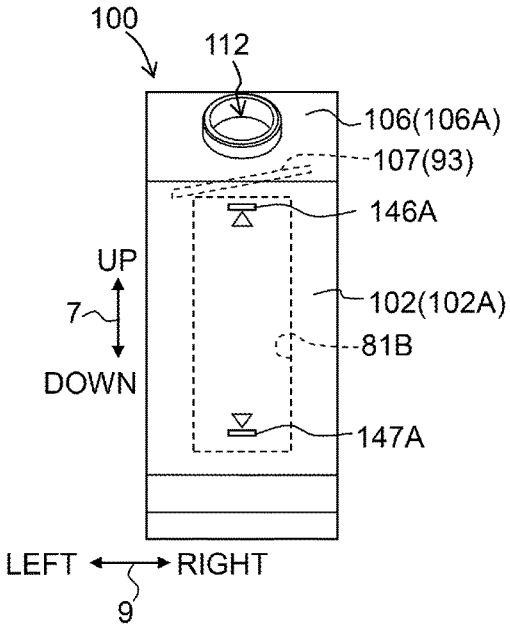

For example, as depicted in FIG. 11B, the partitioning wall 93 may extend from a position on the left of the left end of the non-offset portions 146A and 147A to a position on the right of the right end of the non-offset portions 146A and 147A. Namely, the partitioning wall 93 may extend to outer sides of the non-off set portion 146A and 147A in the left-right direction 9.

In FIG. 11B, the partitioning wall 93 extends to the outer sides of the inlet 112 in the left-right direction 9. The extending range of the partitioning wall 93, however, is not limited thereto. For example, the left end of the partitioning wall 93 may be disposed at a position, in the left-right direction 9, between the left end of the inlet 112 and the left end of the non-offset portions 146A, 147A, and the right end of the partitioning wall 93 may be disposed at a position, in the left-right direction 9, between the right end of the inlet 112 and the right end of the non-offset portions 146A, 147A.

Figure 11C:
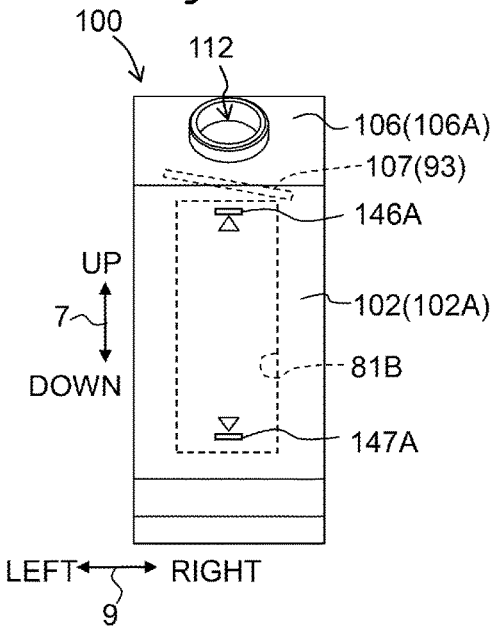

In the second embodiment, the partition wall 93 is inclined downward and leftward. The partitioning wall 93, however, may be inclined downward and rightward, as depicted in FIG. 11C.

Figure 11D:
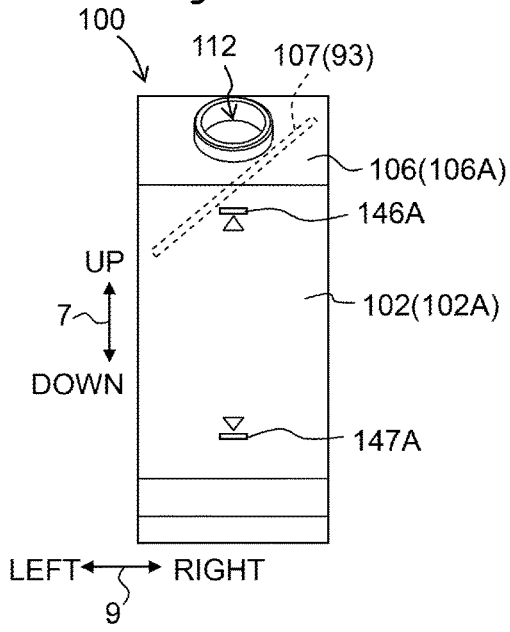

In the second embodiment, the partitioning wall 93 is disposed at a position, in the up-down direction 7, between the inlet 112 and the non-offset portions 146A, 147A. However, at least a part of the partitioning wall 93 may be disposed at a position, in the up-down direction 7, between the inlet 112 and the non-offset portions 146A, 147A. For example, as depicted in FIG. 11D, the partitioning wall 93 may extend from a position above the lower end of the inlet 112 to a position below the non-offset portion 146A. Or, for example, the partitioning wall 94 may extend to a position above the inlet 112.

Figure 12A:
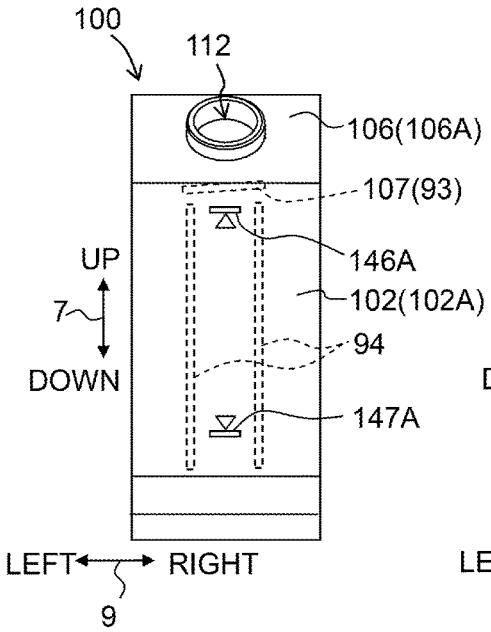
FIGS. 12A to 12D are front views of other modified examples of the ink tank according to the second embodiment of the present teaching.

As depicted in FIG. 12A, in addition to the partitioning wall 93, two partitioning walls 94 may be formed as the partitioning walls 107 that extend rearward from at least one of the inner surface 102B of the upright wall 102 and the inner surface 106B of the inclined wall 106.

Each partitioning wall 94 extends rearward to the same position as the partitioning wall 93. Each partitioning wall 94 may extend rearward to a position different from that of the partitioning wall 93.

As depicted in FIG. 12A, each partitioning wall 94 is formed at a position, in the left-right direction 9, different from those of the non-offset portions 146A and 147A. The partitioning walls 94 extend in the up-down direction 7.

Each partitioning wall 94 is only required to extend in a direction having a component of the up-down direction 7. Namely, each partitioning wall 94 may be inclined to the up-down direction 7 (e.g., see FIG. 12B). When each partitioning wall 94 is inclined to the up-down direction 7, an end of each partitioning wall 94 may be in the same position as an end of the non-offset portions 146A and 147A in the left-right direction 9 (e.g., see FIG. 12C).

In FIG. 12A, each partitioning wall 94 extends from a position above the non-offset portion 146A to a position below the non-offset portion 147A. The extending range of the partitioning wall 94 in the up-down direction 7, however, is not limited thereto. For example, each partitioning wall 94 may extend from a position above the non-offset portion 146A to a position between the non-offset portion 146A and the non-offset portion 147A (e.g., see FIG. 12C). Or, for example, each partitioning wall 94 may be formed only at a position above the non-offset portions 146A and 147A.

Figure 12B:
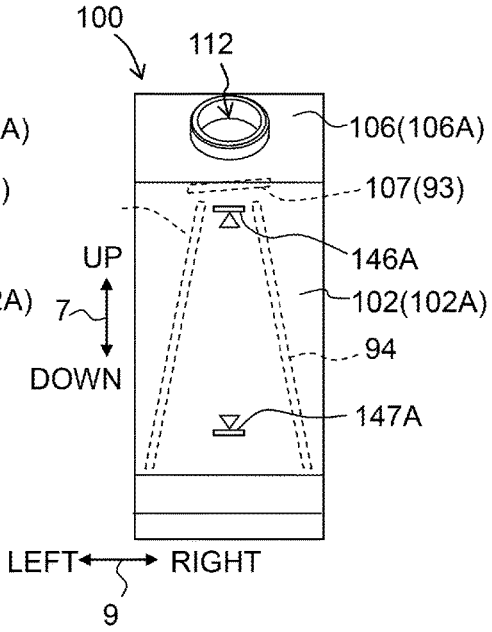
Figure 12C:
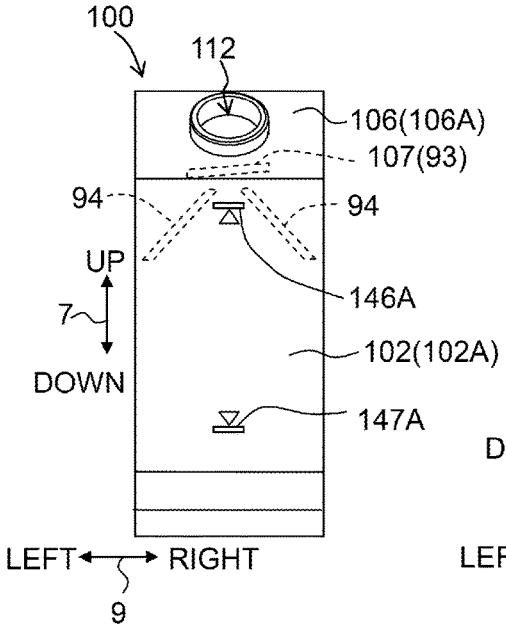
Figure 12D:
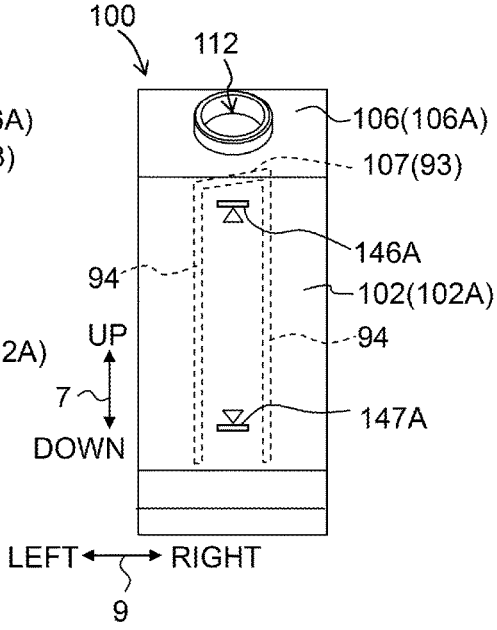

As depicted in FIGS. 12A to 12C, each partitioning wall 94 may be formed to be separated from the partitioning wall 93. Or, as depicted in FIG. 12D, each partitioning wall 94 may be connected to the partitioning wall 93.

<Function and Effect of Second Embodiment>

In the second embodiment, the partitioning wall 93 is disposed at a position, in the up-down direction 7, between the inlet 112 and the non-offset portions 146A, 147A (e.g., see FIG. 11A). In that configuration, when the ink supplied from the inlet 112 flows downward or is scattered, it is possible to reduce the adhesion of ink to areas, of the inner surface 102B of the upright wall 102, corresponding to the non-offset portions 146A and 147A and peripheries thereof. This allows a user to accurately confirm an amount of ink stored in the ink tank 100 from the outside.

In the second embodiment, the partitioning wall 93 extends beyond the non-offset portions 146A and 147A in the left-right direction 9 (e.g., see FIG. 11B). Thus, unlike a configuration in which the partitioning wall 93 is formed only immediately above the non-offset portions 146A and 147A, it is possible to reduce the adhesion of ink to areas, of the inner surface 102B of the upright wall 102, corresponding to the non-offset portions 146A and 147A and peripheries thereof.

In the second embodiment, the partitioning wall 93 extends beyond the inlet 112 in the left-right direction 9 (e.g., see FIG. 11B). Thus, unlike a configuration in which the partitioning wall 93 is formed only in the same position as the inlet 112 in the left-right direction 9, it is possible to reduce the adhesion of ink to areas, of the inner surface 102B of the upright wall 102, corresponding to the non-offset portions 146A and 147A and peripheries thereof.

In the second embodiment, the partitioning wall 93 may extend to a position above the inlet 112. In that configuration, the ink supplied from the inlet 112 is prevented from flowing or being scattered in the left-right direction 9.

The ink supplied from the inlet 112 may flow or be scattered to the outer sides of the partitioning wall 93 in the left-right direction 9. In that case, the ink may adhere to areas, of the inner surface 102B of the upright wall 102, corresponding to the non-offset portions 146A and 147A and peripheries thereof, from both sides in the left-right direction 9 of the areas. In the second embodiment, each partitioning wall 94 (see FIGS. 12A to 12D) can reduce the ink adhesion described above.

In the second embodiment, each partitioning wall 94 extends from a position above the upper end of each of the non-offset portions 146A and 147A to a position below the upper end of each of the non-offset portions 146A and 147A (e.g., see FIG. 12A). Thus, unlike a configuration in which each partitioning wall 94 is formed only at a position above the upper end of each of the non-offset portions 146A and 147A, it is possible to reduce the adhesion of ink to areas, of the inner surface 102B of the upright wall 102, corresponding to the non-offset portions 146A and 147A and peripheries thereof.

In the second embodiment, each partitioning wall 94 extends to a position below the lower end of each of the non-offset portions 146A and 147A (e.g., see FIG. 12A). Thus, unlike a configuration in which the partitioning wall 94 is formed only at a position above the lower end of each of the non-offset portions 146A and 147A, it is possible to reduce the adhesion of ink to areas, of the inner surface 102B of the upright wall 102, corresponding to the non-offset portions 146A and 147A and peripheries thereof.

In the second embodiment, each partitioning wall 94 is connected to the partitioning wall 93 (e.g., see FIG. 12D). Thus, there is no gap between the partitioning wall 93 and each partitioning wall 94, preventing the ink from passing therethrough. This makes it possible to reduce the adhesion of ink to areas, of the inner surface 102B of the upright wall 102, corresponding to the non-offset portions 146A and 147A and peripheries thereof.

<Modified Examples of the First and Second Embodiments>

Figure 13:
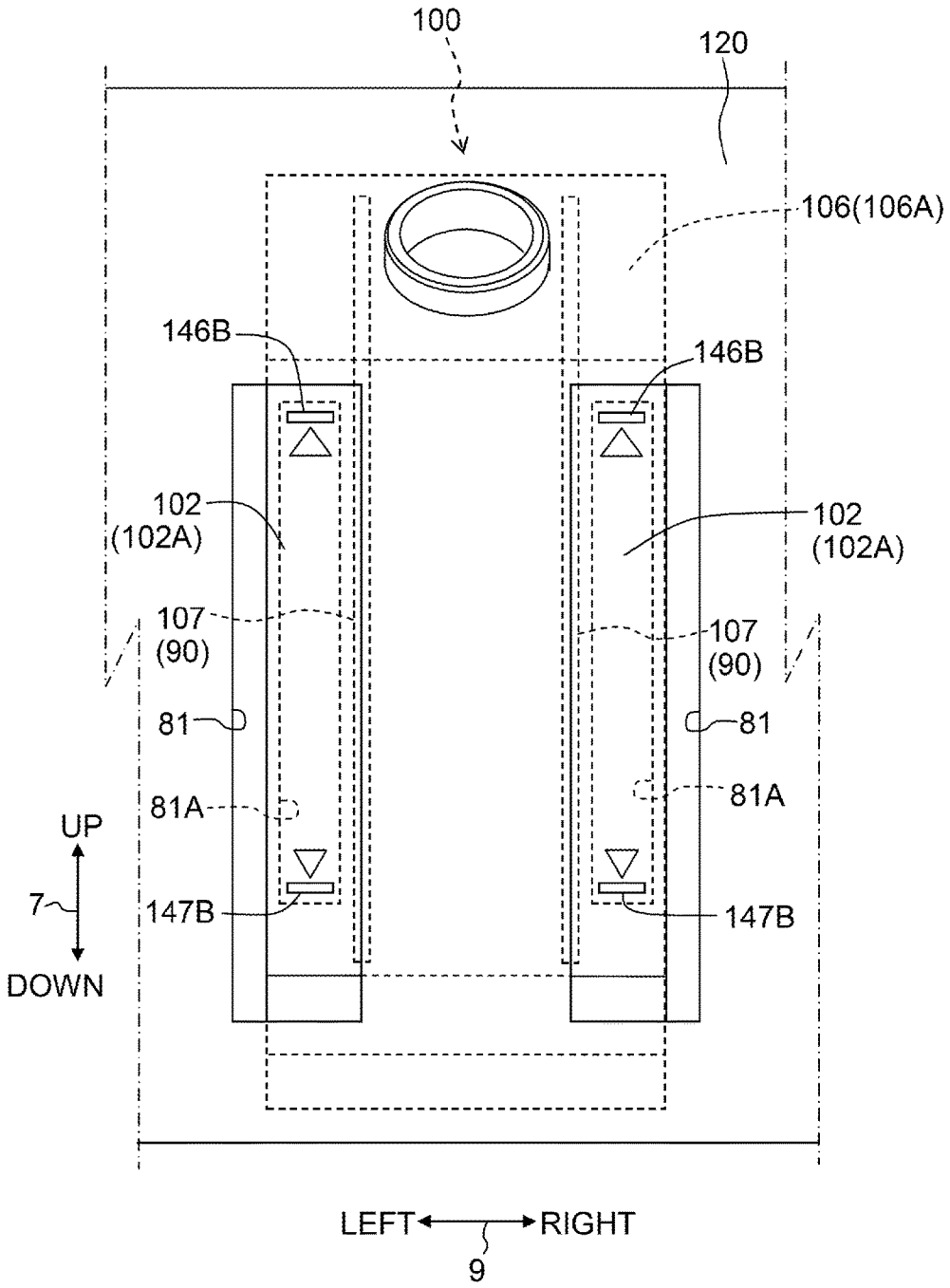
FIG. 13 is a partial front view of an ink tank and a holding member.

In each of the first and second embodiments, each opening 81 of the holding member 120 exposes the substantially entire surface of each upfront wall 102. Each opening 81, however, may expose only a part, of the outer surface of the corresponding upfront wall 102, separated from the inlet 112 by the partitioning walls 90 and 91. In the first embodiment, for example, as depicted in FIG. 13, each opening 81 may expose a part, of the front surface 102A of the corresponding upright wall 102, on an opposite side of the inlet 112 to the partitioning wall 90 in the left-right direction 9. FIG. 13 depicts one of the four ink tanks 100 and two of the openings 81 provided in the holding member 120. In the modified example depicted in FIG. 13, a part of the partition wall 90 extending in the up-down direction, the right wall 103, and left wall 108 of the ink tank 100 are exposed through the openings 81. In that case, a user visually confirms, through the openings 81, parts which are not necessarily required to be visually confirmed by a user. Thus, instead of each opening 81 depicted in FIG. 13, each opening 81A depicted by a broken line in FIG. 13 may be provided in the holding member 120. In a configuration using each opening 81A, those except for the offset portions 146B and 147B and marks "Δ" and "∇" are not exposed through the opening 81A. In other words, a part that is not necessarily required to be visually confirmed by a user through the opening 81 (a part of the partitioning wall 90 extending in the up-down direction, the right wall 103, and the left wall 108 of the ink tank 100) are not exposed through the opening 81A when a user sees the ink tank 100 from the front side. Or, it may be described that a part of the partitioning wall 90, the right wall 103, and the left wall 108 of the ink tank 100 are in positions not overlapping with the opening 81A when a user sees the ink tank 100 from the front side. This allows a user to clearly confirm only a part that is required to be visually confirmed by a user through the opening 81. Also in that case, at least one of the offset portions 146B and 147B may be exposed through the opening 81A, and the marks "Δ" and "∇" are not necessarily exposed through the opening 81A. Namely, the marks "Δ" and "∇" may not be provided. Meanwhile, in the second embodiment, as depicted by broken lines in FIG. 11B and 11C, an opening 81B may expose a part of, the front surface 102A of the upfront wall 102, positioned immediately below the partitioning wall 93. The mark "Δ" indicates that the offset portion 146B is provided at the position corresponding to the liquid surface of the ink when the maximum permissible storage amount of ink has been stored in the ink chamber 111 in the usable posture of the multifunction peripheral 10. The mark "∇" indicates that the offset portion 147B is provided at the position corresponding to the liquid surface of the ink when the minimum permissible storage amount of ink has been stored in the ink chamber 111 in the usable posture of the multifunction peripheral 10. These marks may have any shape provided that the above meanings can be indicated, without being limited to the shapes of "Δ" and "∇".

In this modified example, the opening 81 exposes a part of the upright wall 102 to which the ink supplied is not likely to adhere by virtue of the partitioning walls 90 and the like. This makes it possible for a user to easily confirm an amount of ink stored in the ink chamber 111. A part of the upfront wall 102, to which the ink supplied easily adheres, is covered with the holding member 120, making it possible to hide a part of the upright wall 102, to which the ink adheres due to the scattering in its supply, from the outside.

In the above embodiments, the first line 146 and the second line 147 are formed in the front surface 102A of the upright wall 102 of the front wall 101. However, as depicted in FIGS. 14A and 14B, the first line 146 and the second line 147 may not be formed in the front surface 102A. In that configuration, at least a part of the partitioning wall 90 is disposed at a position below the inlet 112 and positioned between the inlet 112 and the offset area 115 in the left-right direction 9 (e.g., see FIG. 14A). Further, in that configuration, at least a part of the partitioning wall 93 may extend, below the inlet 112, from a left end to a right end of the non-offset area 114 (e.g., see FIG. 14B).

The configurations of the partitioning walls 90 and 93 are not limited to those depicted in FIGS. 14A and 14B, which may be, for example, those depicted in FIGS. 8A to 12D in the above embodiments. In other words, in FIGS. 8A to 12D, the first line 146 and the second line 147 may not be formed in the front surface 102A.

In the above embodiments, the entire ink tank 100 is formed from a resin having translucency to enable ink in the ink chamber 111 to be visually confirmed from the outside of the ink tank 100. However, any other wall than the upright wall 102 of the front wall 101 among the walls included in the ink tank 100 may be formed from a material other than the resin having the translucency.

In the above embodiments, the tank set 99 includes the holding member 120. The tank set 99, however, may not include the holding member 120. In that case, the four ink tanks 100 may be individually installed in the coupling member 200 without being integrated with each other by the holding member 120.

In the above embodiments, the ink is explained as an exemplary liquid. The present teaching, however, is not limited thereto. Namely, instead of the ink, the likes of a pretreatment liquid discharged onto a recording sheet prior to the ink during printing, or water sprayed in a vicinity of the nozzle 40 of the recording head 39 for preventing drying of the nozzle 40 of the recording head 39, are also an example of a liquid.

What is claimed is:

1. A tank installed in a liquid consuming apparatus, comprising:

a first wall forming a first end, in a first direction along a horizontal direction, of a storage chamber configured to store liquid to be consumed in the liquid consuming apparatus, the first wall allowing the liquid stored in the storage chamber to be visually confirmed from outside the tank;

a second wall forming a second end of the storage chamber which faces the first end of the storage chamber in the first direction;

a third wall connected to an upper end of the first wall and having an inlet through which the liquid is supplied to the storage chamber; and an inner wall protruding from at least one of an inner surface of the first wall and an inner surface of the third wall toward the second wall, the inner wall extending in a direction having a component of an up-down direction when viewed from the first direction, wherein each of the inner surface of the first wall and the inner surface of the third wall includes an offset area which is in a position different from that of the inlet in a second direction orthogonal to the first direction and the up-down direction, and at least a part of the inner wall is positioned below the inlet and positioned between the inlet and the offset area in the second direction.

2. The tank according to claim 1, further comprising a scale formed on an outer surface of the first wall to indicate an amount of the liquid stored in the storage chamber, wherein the scale includes an offset portion formed in a part of the outer surface of the first wall which corresponds to the offset area; and at least a part of the inner wall is positioned below the inlet in the up-down direction and positioned between the inlet and the offset portion in the second direction.

3. The tank according to claim 2, wherein the inner wall extends from a position above an upper end of the offset portion to a position below the upper end of the offset portion.

4. The tank according to claim 3, wherein the inner wall extends to a position below a lower end of the offset portion.

5. The tank according to claim 2, further comprising: a first sub-inner wall extending from at least one of the inner surface of the first wall and the inner surface of the third wall, wherein at least a part of the first sub-inner wall is positioned between the inlet and the offset portion in the up-down direction and is in the same position as the offset portion in the second direction, and at least a part of the first sub-inner wall extends along at least one of the inner surface of the first wall and the inner surface of the third wall in a direction having a component of the second direction.

6. The tank according to claim 5, wherein the first sub-inner wall extends to a position different from that of the offset portion in the second direction.

7. The tank according to claim 5, wherein the first sub-inner wall is connected to the inner wall.

8. The tank according to claim 2, wherein the scale is provided with an upper limit scale to indicate an upper limit of the liquid stored in the storage chamber.

9. The tank according to claim 8, wherein the scale is provided with a lower limit scale to indicate a lower limit of the liquid stored in the storage chamber.

10. The tank according to claim 1, wherein the inner wall extends to a position above the inlet.

11. The tank according to claim 1, wherein the inner wall extends in the up-down direction.

12. A liquid consuming apparatus, comprising:

the tank as defined in claim 1; and a cover configured to cover, from outside the tank, the first wall of the tank, wherein the cover includes an opening by which a part of the first wall on an opposite side of the inlet to the inner wall in the second direction is exposed.

13. The liquid consuming apparatus according to claim 12, wherein the opening does not overlap with the inner wall in the first direction.

14. A tank installed in a liquid consuming apparatus, comprising:

a first wall forming a first end, in a first direction along a horizontal direction, of a storage chamber configured to store liquid to be consumed in the liquid consuming apparatus, the first wall allowing the liquid stored in the storage chamber to be visually confirmed from outside the tank;

a second wall forming a second end of the storage chamber which faces the first end of the storage chamber in the first direction;

a third wall connected to an upper end of the first wall and having an inlet through which the liquid is supplied to the storage chamber; and an inner wall protruding from at least one of an inner surface of the first wall and an inner surface of the third wall toward the second wall, the inner wall extending in a direction intersecting with an up-down direction when viewed from the first direction, wherein each of the inner surface of the first wall and the inner surface of the third wall includes a non-offset area which is in the same position as the inlet in a second direction orthogonal to the first direction and the up-down direction, and at least a part of the inner wall is positioned below the inlet and extends from one end to the other end of the non-offset area in the second direction.

15. The tank according to claim 14, further comprising a scale formed on an outer surface of the first wall to indicate an amount of the liquid stored in the storage chamber, wherein the scale includes a non-offset portion formed in the same position as the inlet in the second direction, and at least a part of the inner wall is positioned between the inlet and the non-offset portion in the up-down direction and extends from one end to the other end of the non-offset portion in the second direction.

16. The tank according to claim 15, wherein the inner wall extends to an outer side of the non-offset portion in the second direction.

17. The tank according to claim 15, further comprising a sub-inner wall extending from at least one of the inner surface of the first wall and the inner surface of the third wall, wherein at least a part of the sub-inner wall is formed in a position different from that of the non-offset portion in the second direction, and at least a part of the sub-inner wall extends along at least one of the inner surface of the first wall and the inner surface of the third wall, in a direction having a component of the up-down direction.

18. The tank according to claim 17, wherein the sub-inner wall extends from a position above an upper end of the non-offset portion to a position below the upper end of the non-offset portion.

19. The tank according to claim 18, wherein the sub-inner wall extends to a position below a lower end of the non-offset portion.

20. The tank according to claim 17, wherein the sub-inner wall is connected to the inner wall.

21. The tank according to claim 15, wherein the scale is provided with an upper limit scale indicating an upper limit of the liquid stored in the storage chamber.

22. The tank according to claim 21, wherein the scale is provided with a lower limit scale indicating a lower limit of the liquid stored in the storage chamber.

23. The tank according to claim 14, wherein the inner wall extends to an outer side of the inlet in the second direction.

24. The tank according to claim 23, wherein the inner wall extends to a position above the inlet.

25. A liquid consuming apparatus, comprising:

the tank as defined in claim 14; and a cover configured to cover, from outside the tank, the first wall of the tank, wherein the cover includes an opening by which a part of the first wall positioned immediately below the inner wall is exposed.

* * * * *